US006161251A

United States Patent [19]

Lee et al.

[11] Patent Number: 6,161,251

[45] Date of Patent: Dec. 19, 2000

[54] SUCTION NOZZLE FOR VACUUM CLEANER

[75] Inventors: Dong Yool Lee; Ju Han Yoon; Yong Bok Choi; Kyoung Suk Lim; Hoi Kil Jeong; Sang Jun Park, all of Kyungsangnam-do, Rep. of Korea

[73] Assignee: LG Electronics, Inc., Seoul, Rep. of Korea

[21] Appl. No.: 09/237,888

[22] Filed: Jan. 27, 1999

[30] Foreign Application Priority Data

Sep. 1, 1998 [KR] Rep. of Korea ..... 98-35908
Dec. 31, 1998 [KR] Rep. of Korea ..... 98-62815

[51] Int. Cl.[7] ..... A47L 9/04

[52] U.S. Cl. ..... 15/379; 15/404; 15/415.1; 15/421

[58] Field of Search ..... 15/421, 379, 404, 15/415.1, 402

[56] References Cited

U.S. PATENT DOCUMENTS

| | | | |
|---|---|---|---|
| 2,031,957 | 2/1936 | Karlstrom | 15/379 X |
| 2,096,517 | 10/1937 | Hurley | 15/404 X |
| 2,178,003 | 10/1939 | Smellie | 15/379 X |
| 2,280,751 | 4/1942 | Davis | 15/415.1 X |
| 2,658,228 | 11/1953 | Meyerhoefer | 15/415.1 X |
| 2,825,925 | 3/1958 | Acheson | 15/379 X |
| 2,864,119 | 12/1958 | Crise | 15/404 |
| 3,203,023 | 8/1965 | Jepson et al. | 15/402 X |
| 3,225,379 | 12/1965 | Cummins | 15/402 X |
| 5,033,148 | 7/1991 | Chauvier et al. | 15/404 X |

FOREIGN PATENT DOCUMENTS

| | | | |
|---|---|---|---|
| 494500 | 3/1930 | Germany | 15/404 |
| 86762 | 7/1936 | Sweden | 15/379 |

*Primary Examiner*—Chris K. Moore
*Attorney, Agent, or Firm*—Fleshner & Kim, LLP

[57] ABSTRACT

Suction nozzle for a vacuum cleaner including a suction nozzle body including; a main air flow passage having a main suction hole for drawing external air and a discharge hole for providing the drawn air to a body of the vacuum cleaner, and a supplementary air flow passage having a supplementary air flow passage for drawing external air and an opening for providing the external air drawn through the supplementary suction hole to the main air flow passage, and vibration generating means mounted in the supplementary air flow passage for generating a vibrating force by an air flow drawn through the supplementary suction hole, thereby facilitating an automatic removal of various foreign matters stuck to a surface of bedding, whereby improving a cleaning efficiency.

48 Claims, 27 Drawing Sheets

SUCTION NOZZLE FOR VACUUM CLEANER

BACKGROUND OF THE INVENTION

1. Field of the Invention

The present invention relates to a vacuum cleaner, and more particularly, to a suction nozzle for drawing air containing dust and the like.

2. Background of the Related Art

A related art vacuum cleaner will be explained with reference to the attached drawings. FIG. 1 illustrates a perspective disassembled view of the related art vacuum cleaner.

Referring to FIG. 1, a body 1 of the vacuum cleaner 1 is provided with a lower cover 1*a* and an upper cover 1*b*. A suction hose 3 has one end coupled to a suction hole 2 in the upper cover 1*b* of the body 1 and another end coupled to a hand grip 4 with a control unit. One end of an extension tube 5 is detachably coupled to the hand grip 4, and the other end is connected to one end of a connection tube 63. The other end of the connection tube 63 is coupled to the suction nozzle 6.

Various components in the body 1 will be explained, with reference to FIG. 2.

The body 1 is provided with a suction hole 2 for drawing in external air and a discharge hole 11 for discharging the air. There is a dust collecting bag 9 surrounding one end of the suction hose 3, which is inserted in the suction hole 2. The dust collecting bag 9 is used for filtering dust and foreign matters drawn into the body along with the air. An air filter 12 is provided in front of the discharge hole 11 for filtering fine particles which are not filtered out of the air flow by the dust collecting bag 9. A motor 7 and a fan 8 are provided between the dust collecting bag 9 and the discharge hole 11 for generating a suction force. A motor protection filter 10 is located in front of the fan 8.

There are many kinds of suction nozzles 6 which can be used with a device as shown in FIGS. 1 and 2. A user would select an appropriate suction nozzle 6 depending on what functions are to be performed. For example, when bedding, such as blankets and mattresses are to be cleaned, a suction nozzle for bedding may be used.

A background art bedding suction nozzle will be explained with reference to FIGS. 3 and 4. The bedding suction nozzle 60 has an internal cavity and is provided with a suction nozzle body 61, which forms an outside shell of the suction nozzle 60. Wheels are rotatably fitted at both sides of the suction nozzle body 61. A connection tube 63 is coupled at a rear of the suction nozzle body 61. The suction nozzle body 61 has a main suction hole 61*a* at a bottom thereof for drawing in external air, and a bypass hole 61*b* at top thereof for drawing in external air.

The operation of the related art vacuum cleaner will be explained with reference to FIGS. 2 and 3. Upon putting the vacuum cleaner into operation, the motor 7 in the body 1 is driven to rotate the fan 8, to generate a suction force. Then, external air carrying dust and the like is drawn through the suction nozzle 6 and flows into the dust collecting bag 9 via the suction hose 3. Most foreign matter in the air flow is filtered out and remains in the dust collecting bag 9. Fine particles which are not filtered out of the airflow by through the dust collecting bag 9 travel to a rear of the body 1, and are filtered out of the airflow by the air filter 12. The airflow is then discharged outside of the vacuum cleaner body 1 through the discharge hole 11.

The operation of the bedding suction nozzle will be explained with reference to FIG. 4. When a suction force is generated upon putting the vacuum cleaner into operation, most of the external air that passes through the connection tube 63 is drawn into the nozzle through the main suction hole 61*a*. However, a portion of the airflow exiting the nozzle is also drawn through the bypass hole 61*b*. As most bedding is formed of cloth, when cleaning the bedding, a portion of the cloth bedding may be partially drawn into the main suction hole 61*a* by the suction force of the vacuum cleaner. This blocks the main suction hole 61*a*, thus impeding drawing of the external air into the suction nozzle 60. This also impedes the cleaning operation. However, the external air drawn in through the bypass hole 61*b* in the top of the suction nozzle body 61 helps to allow the cloth stuck to the main suction hole 61*a* to come apart therefrom, thereby allowing the cleaning operation to continue.

However, the related art bedding suction nozzle has the following problems.

First, the related art bedding suction nozzle merely draws in dust and various foreign matters such as hair stuck to the bedding only using a suction force. However, because some foreign matter stuck to the bedding does not easily come apart from the bedding, the cleaning operation is not always effective. This makes the related art bedding suction nozzle inconvenient to use because the user must repeatedly go over the same portion of the bedding several times to remove all foreign matter. Alternatively, a cleaning operation using the vacuum cleaner can only be carried out after dust has already been shaken off the bedding.

Second, as noted above, when the bedding becomes stuck to the suction nozzle during a cleaning operation, it impedes use of the vacuum cleaner and reduces the effectiveness of the cleaning work. Despite the provision of the bypass hole in a top of the suction nozzle body, when a portion of the bedding is drawn into and blocks the main suction hole, it still impairs the cleaning operation.

SUMMARY OF THE INVENTION

Accordingly, the present invention is directed to a suction nozzle for a vacuum cleaner that substantially obviates one or more of the problems and disadvantages of the related art.

An object of the present invention is to provide a suction nozzle for a vacuum cleaner which can draw in various foreign matter, such as dust and the like, which is stuck to bedding without first having to shake off certain foreign matter before cleaning the bedding with the suction nozzle.

Another object of the present invention is to provide a suction nozzle for a vacuum cleaner which can prevent the suction nozzle from becoming stuck to the bedding, thereby improving its convenience in use.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereofas well as the appended drawings.

To achieve these and other advantages and in accordance with the purpose of the present invention, as embodied and broadly described, the suction nozzle for a vacuum cleaner includes a suction nozzle body including a main air flow passage having a main suction hole for drawing in external air, and a discharge hole for providing the airflow to a body of the vacuum cleaner. The suction nozzle body also includes a supplementary suction hole that opens into a supplementary air flow passage for drawing in external air, and an opening for providing the airflow drawn through the supplementary suction hole to the main air flow passage. The suction nozzle body further includes vibration generating means, mounted in the supplementary air flow passage, for generating a vibrating force using the air flow drawn through the supplementary suction hole.

The vibration generating means may include a duct having an opened upper end and an opened lower end, both for allowing air flow, and a flow passage at one side thereof connected to the opening. A moving member is disposed in the duct for making up and down movements according to a suction direction of the air drawn into the duct. A vibrating member adapted to make up and down movements following the up and down movements of the moving member selectively opens and closes the upper end and a lower end of the duct, and at the same time generates a vibration force.

The moving member may include at least one moving plate having a diameter smaller than an inside diameter of the duct. The vibrating member would also include an upper cover for selectively opening and closing a top of the duct, a lower cover for selectively opening and closing a bottom of the duct, and a connecting shaft for connecting the upper cover and the lower cover.

The connecting shaft preferably has a lower end that extends through a bottom surface of the housing and that is fixed to a vibration plate. The vibration plate directly hits the bedding when the vibrating member makes a down movement, for generating vibration.

The supplementary suction hole is fitted with a cover for selective opening and closing the supplementary air flow passage. The vibrating plate is preferably designed to be selectively operative, and a transparent window is preferably fitted to the suction nozzle body for checking an operation state of the vibration generating means.

A recess may be formed in a bottom surface of the suction nozzle body, and, preferably, a bottom plate is detachably fitted to the recess.

There is preferably a blast air flow passage in the suction nozzle body for blasting air from the bottom of the suction nozzle body to more efficiently separate dust and the like from bedding.

An overload protection device is preferably mounted in the supplementary air flow passage for preventing the supplementary air flow passage from being overloaded.

A suction nozzle for a vacuum cleaner embodying the present invention can separate foreign matter from a surface of the bedding without the need for a separate shaking operation. This improves a cleaning efficiency, and also prevents blocking of the main suction hole in the suction nozzle.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIGS. 11A and 11B illustrate perspective views of a bedding suction nozzle for a vacuum cleaner in accordance with a fourth preferred embodiment of the present invention, wherein FIG. 11A is seen from top and FIG. 11B is seen from bottom;

FIGS. 14A and 14B respectively illustrate perspective views of the bottom supporting plate shown in FIG. 13, wherein FIG. 14A is seen from top and FIG. 14B is seen from bottom;

DETAILED DESCRIPTION OF THE PREFERRED EMBODIMENTS

Reference will now be made in detail to the preferred embodiments of the present invention, examples of which are illustrated in the accompanying drawings.

FIRST EMBODIMENT

Figure 1:
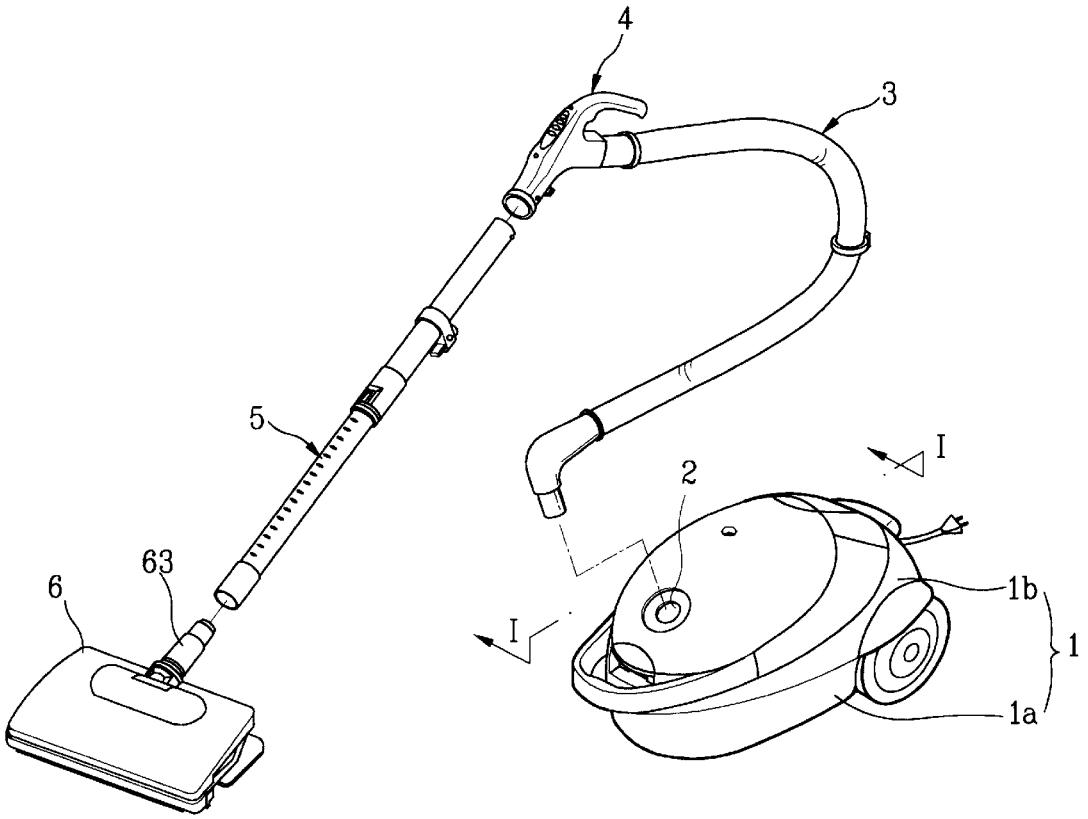
FIG. 1 Background Art
FIG. 1 illustrates a perspective disassembled view of a related art vacuum cleaner.
Figure 2:
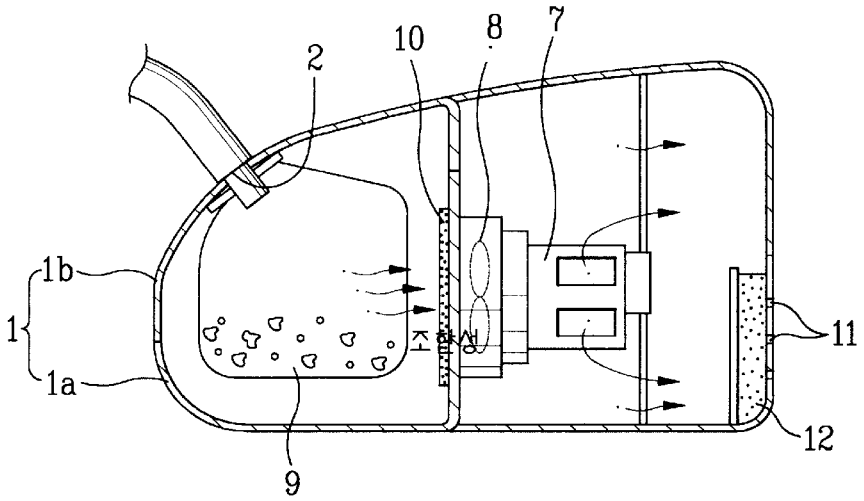
FIG. 2 Background Art
FIG. 2 illustrates a section across line I—I in FIG. 1.
Figure 3:
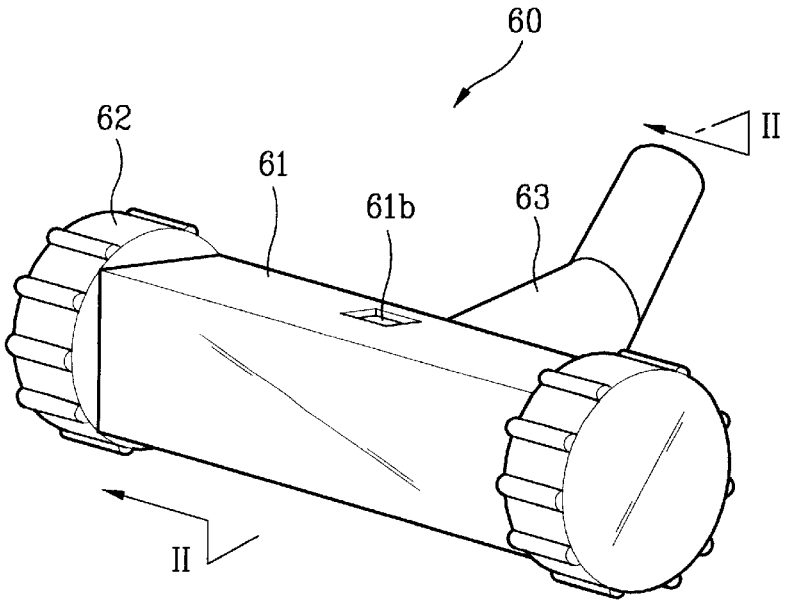
FIG. 3 Background Art
FIG. 3 illustrates a perspective view of a related art bedding suction nozzle for a vacuum cleaner.
Figure 4:
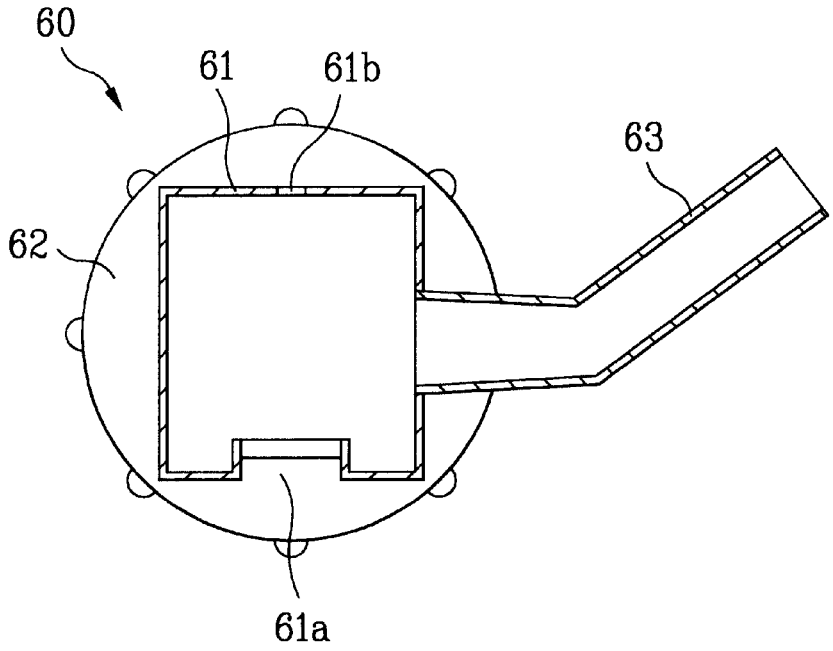
FIG. 4 Background Art
FIG. 4 illustrates a section across line II—II in FIG. 3.
Figure 5:
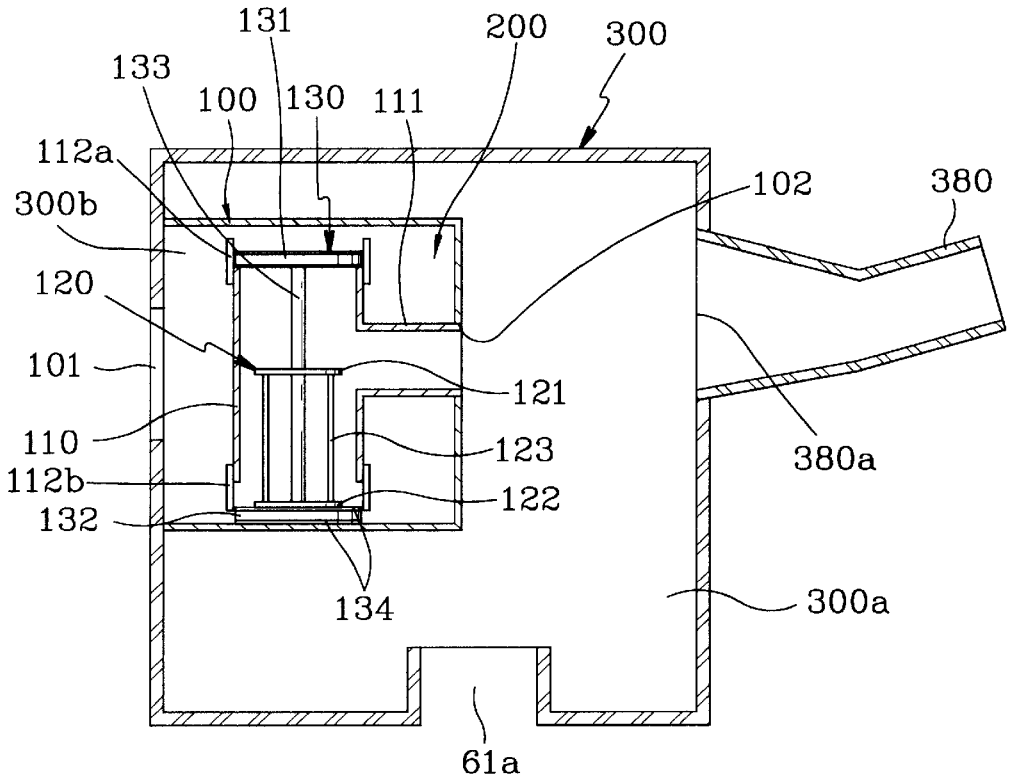
FIG. 5 illustrates a cross section of a suction nozzle for a vacuum cleaner in accordance with a first preferred embodiment of the present invention.
Figure 6:
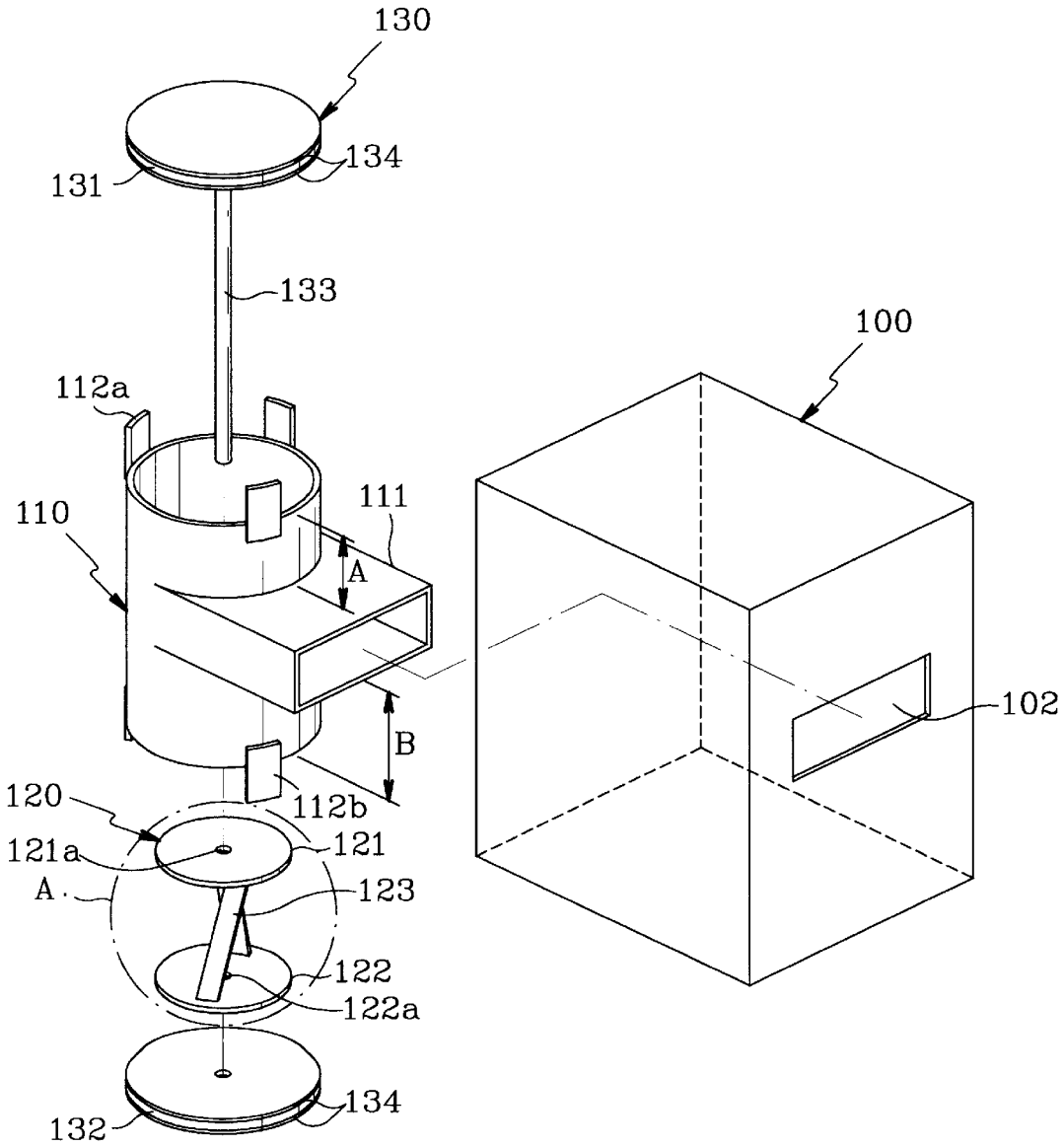
FIG. 6 illustrates a perspective disassembled view of the suction nozzle shown in FIG. 5.

FIG. 5 illustrates a cross section of a suction nozzle for a vacuum cleaner in accordance with a first preferred embodiment of the present invention, and FIG. 6 illustrates a perspective disassembled view of the suction nozzle shown in FIG. 5, referring to which the first preferred embodiment will be explained.

Referring to FIG. 5, an overall structure of a suction nozzle for a vacuum cleaner of the present invention will be explained. There is a suction nozzle body 300 having a main suction hole 61*a* formed in a bottom surface thereof and a supplementary suction hole 101 in another surface thereof. The suction nozzle body 300 has a discharge hole 380*a* in a rear surface thereof for discharging air drawn therein through a connection tube 380 to a body of the vacuum cleaner. The interior of the suction nozzle body 300 is divided into a main air flow passage 300*a* and a supplementary air flow passage 300*b* so that the air drawn through the main suction hole 61*a* directly flows to the body of the vacuum cleaner through the discharge hole 380*a*, and air drawn through the supplementary suction hole 101 flows to the discharge hole 380*a* through a vibration generating means 200. The main air flow passage 300*a* is preferably formed to be in communication with the supplementary air flow passage 300*b*, for directing the air passed through the supplementary air flow passage 300*b* to the body of the vacuum cleaner. The supplementary air flow passage 300*b* can be implemented in various ways. In this embodiment, the supplementary air flow passage 300*b* is formed by mounting a housing 100 in the suction nozzle body 300 having one side opened to the supplementary suction hole 101 and the other side having an opening 102 opened to the main air flow passage 300*a*.

There is the vibration generating means 200 in the supplementary air flow passage 300*b*, i.e., in the housing 100, for generating vibration using the air flowing through the supplementary suction hole 101. The vibration generating means 200 will be explained with reference to FIGS. 5 and 6.

There is a duct 110 in the housing 100. The duct 110 has openings at its top and bottom, and a flow passage 111 at one side connected to the opening 102. There is a moving member 120 in the duct 110 for rising or dropping according to a suction force of the air drawn into the duct 110. There is also a vibrating member 130 which surrounds the moving member 120 for vibrating the suction nozzle body 300 by selectively opening/closing the top and the bottom of the duct 110 and by hitting the housing according to the up and down movement of the moving member 120. It is preferable that a plurality of upper guide pieces 112*a* and lower guide pieces 112*b* are fitted on outside of the duct 110 at the top and the bottom thereof at fixed intervals around the circumference of the duct 110. The upper and lower guide pieces help to guide the up and down movement of the vibrating member 130.

Figure 7:
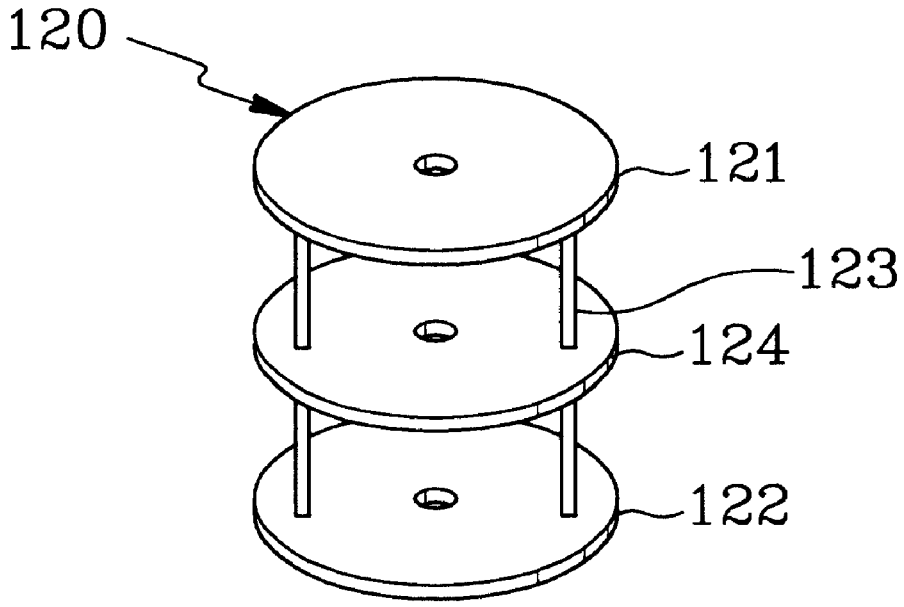
FIG. 7 illustrates a perspective view of a modified version of the moving member shown in FIG. 5.

The moving member 120 includes an upper plate 121 for generating a rising force when air flows in from the bottom of the duct 110, a lower plate 122 for generating a dropping force when air flows in from the top of the duct 110, and at least one connecting member 123 for connecting the upper plate 121 and the lower plate 122. It is preferable that the connecting members 123 are tilted between the upper plate 121 and the lower plate 122 at an angle with reference to a vertical line, and that the connecting members 123 are located opposite one another. As shown in FIG. 7, a supplementary moving plate 124 is preferably fitted between the upper plate 121 and the lower plate 122, for more smooth reception of the rising and dropping forces.

The vibrating member 130 includes an upper cover 131 and a lower cover 132 for opening/closing an upper side and a lower side of the duct 110 according to the up and down movement of the moving member 120. A connecting shaft 133 connects the upper and lower covers 131 and 132. The connecting shaft 133 is preferably fitted to pass through holes 121*a* and 122*a* in a center of the moving member 120, so that the connecting shaft 133 guides the up and down movement of the moving member 120.

Sound absorbing/vibration damping material 134 of, for example rubber or nonwoven fabric, is preferably fitted on both sides, or either side of the upper cover 131. The sound absorbing/vibration damping material 134 absorbs noises generated when the upper cover 131 and the moving member 120 collide. Sound is also absorbed when the upper cover 131 and the housing 100 collide. It is also preferable to fit the sound absorbing/vibration damping material 134 to the lower cover 132 for the same reason.

The flow passage 111 is preferably formed to surround an outer circumference of the duct 110 in a direction crossing a longitudinal direction of the duct so that the air makes an uniform flow into the flow passage 111 through the upper and lower openings of the duct 110. The moving member 120 has a height greater than a height of the flow passage 111 and approximately half of a total height of the duct 110. If the moving member 120 has a height the same, or similar to the total height of the duct 110 the moving member 120 will only be able to move a short distance before hitting the vibration member 130, and the force of the impact against the vibration member 130 will be small. The duct 110 can be formed to have a substantially identical upper length A and lower length B. Preferably the lower length B is longer than the upper length A to provide a longer rising distance of the moving member 120. The upper, and lower covers 131 and 132 have a diameter greater than an inside diameter of the duct 110, so that they can seal off the upper and lower ends of the duct. A diameter of the upper plate 121 and the lower plate 122 of the moving member 120 have a diameter smaller than the inside diameter of the duct 110 so that the moving member 120 can translate freely up and down within the duct 110.

The operation of the suction nozzle body for a vacuum cleaner of the present invention will be explained with reference to FIGS. 8A–8C.

Figure 8A:
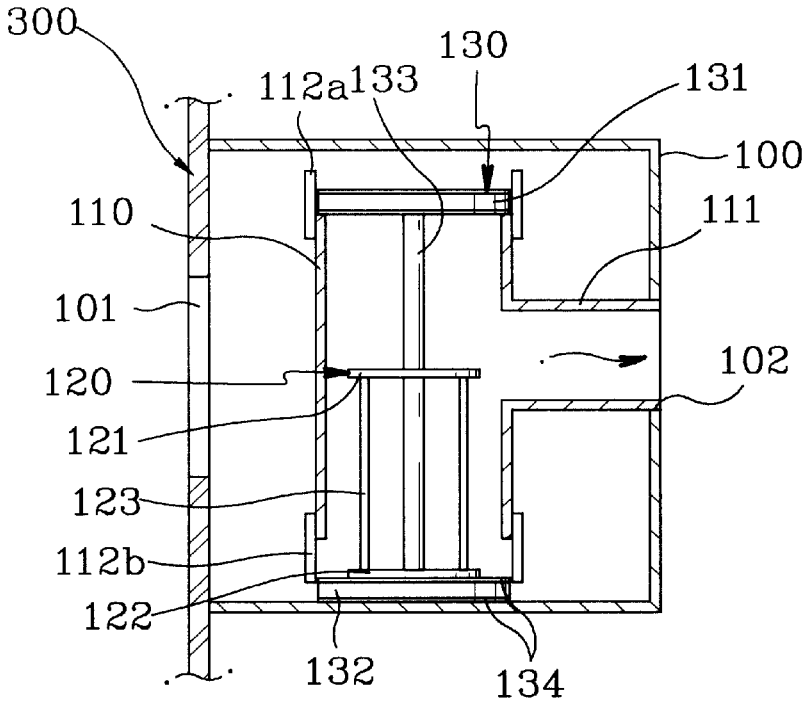
FIGS. 8A, 8B, and 8C respectively illustrate cross sections for explaining operation of the suction nozzle for a vacuum cleaner of the present invention.

Referring to FIG. 8A, the moving member 120 is located at a lower portion of the duct 110 by its own weight when the vacuum cleaner is not in operation. In this instance, the upper cover 131 of the vibrating member 130 is located on top of the duct 110, thus closing the top of the duct 110, and the lower cover 132 is located below the bottom of the duct 110, leaving the bottom of the duct 110 open.

When a user puts the vacuum cleaner into operation, the fan in the body of the vacuum cleaner is rotated to generate a suction force, and the suction force draws air in through the main suction hole 61*a* and the supplementary suction hole 101 in the suction nozzle body 300. The external air drawn through the main suction hole 61*a* flows to the body of the vacuum cleaner through the connection tube 380, directly.

Figure 8B:
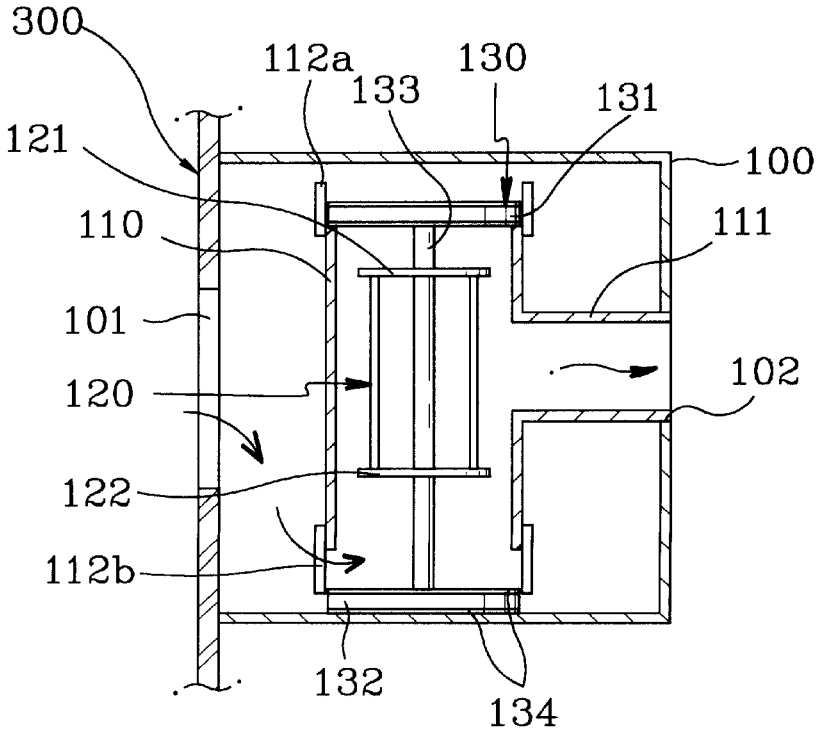

And, as shown in FIG. 8B, since the bottom of the duct 110 is open, the external air drawn through the supplementary suction hole 101 flows into the duct 110 through the bottom of the duct 110, through the flow passage 111, and then into the main body of the vacuum cleaner via the connection tube 380.

Because the flow passage 111 is at a center of the duct 110, the air entering the bottom of the duct 110 rises up to a center portion of the duct 110 where the flow passage 111 is located. The rising air and the suction force through the flow passage 111 cause the moving member 120 to rise upwardly toward the upper portion of the duct 110. Since the connecting members 123 of the moving member 120 are tilted and opposite to one another, the air flow may also generate a rotation force, to rotate the moving member. The rotation of the moving member 120 allows the moving member to rise more smoothly.

Figure 8C:
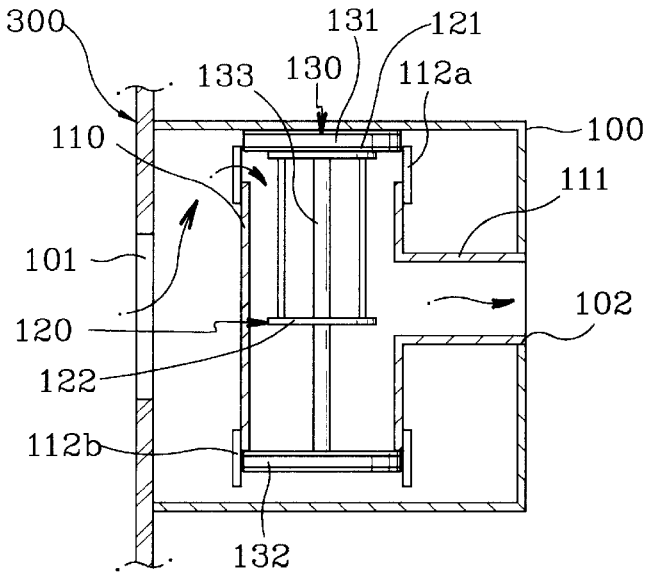

As shown in FIG. 8C, the moving member 120 rising inside the duct 110 hits the upper cover 131 of the vibrating member 130. The impact of the moving member 120 causes the upper cover 131 to rise, thus opening the top of the duct 110. Because the upper cover 131 and the lower cover 132 are connected with the connecting shaft 133, the lower cover 132 also rises until the lower cover 132 is brought into contact with the bottom of the duct 110, and closes the duct 110. Because the bottom of the duct 110 is closed, the air can not flow into the duct 110 through the bottom of the duct 110 anymore. Because the top of the duct 110 is open, the air instead flows into the duct 110 through the top of the duct 110 and then out through the flow passage 111.

The air flowing into the top of the duct 110 pushes the moving member 120 back down toward the bottom of the duct 110. As the moving member 120 moves downward, it hits the lower cover 132 of the vibrating member 130, opening the bottom of the duct 110 and hitting the housing 100. The impact of the lower cover 132 against the housing 100 vibrates the suction nozzle body 300, which is coupled to the housing 100. The downward movement of the vibrating member 300 also causes the upper cover 131 to close the top of the duct 110. Because the dropping speed of the moving member 120 is caused by the air flowing into the top of duct 110 and the weight of the moving member 120 itself, the dropping speed is usually faster than the rising speed. Therefore, the lower plate 122 of the moving member 120 hits the lower cover 132 of the vibrating member 130 with a greater force than the force caused by the upper plate 121 of the moving member 120 hitting the upper cover 131 of the vibrating member 130. And, moreover, since the lower side length B of the duct 110 is greater than the upper side length A of the duct 110, the greater length of drop makes the dropping speed of the moving member 120 the greater than the rising speed, which also causes the impact to be greater.

The sound absorbing/vibration damping material 134 fitted on the upper cover 131 and the lower cover 132 absorb noises generated when the moving member 120 and the vibrating member 130 collide, as well as noises generated when the vibrating member 130 and the duct 110 collide, and noises generated when the vibrating member 130 and the housing 100 collide. The sound absorbing/vibration damping material 134 may also facilitate a better closure of the top and bottom of the duct 110 by the upper cover 131 and lower cover 132, which helps the moving member 120 to make a smooth up and down movement.

As explained above, when the vacuum cleaner is operating, the moving member 120 makes up and down movements in response to the air flowing through the supplementary suction hole 101, and the vibrating member 130 is caused to make corresponding up and down movements. The movements of the vibrating member 130 impacts the housing 100, continuously and repeatedly. According to this, the suction nozzle body 300 coupled to the housing also vibrates. The vibration is transmitted to any bedding brought into contact with the suction nozzle body 300, which helps to separate foreign matter such as dust from the bedding, causing the dust to float in the air. Various foreign matter separated from the surface of the bedding are then drawn into the body of the vacuum cleaner through the main suction hole 61*a* and the supplementary suction hole 101 of the suction nozzle body 300. Thus, the user can clean the bedding with ease.

A portion of the bedding drawn into the main suction hole 61*a* by the suction force of the vacuum cleaner can block the main suction hole 61*a* of the suction nozzle 60 in the middle of the bedding cleaning. In this instance, more external air is caused to flow into the suction nozzle body 300 through the supplementary suction hole 101, which causes even stronger vibrations of the vibration generating means. The stronger vibrations help the cloth blocking the main suction hole 61*a* come off the main suction hole 61*a*. The stronger vibrations also improve the cleaning performance because the foreign matter is better separated from the bedding by the strong vibrations.

Other system configurations may be employed to generate vibrations other than the system in which the upper cover 131 and the lower cover 132 of the vibrating member 130 directly hit the housing. That is, many of the advantages of the foregoing embodiment can be obtained by extending one end of the connecting shaft 133 beyond the duct covers, and then fitting an additional vibrating plate (not shown) onto the extended connecting shaft 133. The up and down movement of the connecting shaft 133 will cause the additional vibrating plate, to hit the housing 100, thus generating vibrations. Also, a plurality of vibration generating means 200 may be provided in appropriate locations of the suction nozzle body 300 to generate the vibration more effectively.

SECOND EMBODIMENT

A suction nozzle for a vacuum cleaner in accordance with a second preferred embodiment of the present invention is identical to the first preferred embodiment in many respects. In the second embodiment, however, the suction nozzle body is vibrated directly.

Figure 9:
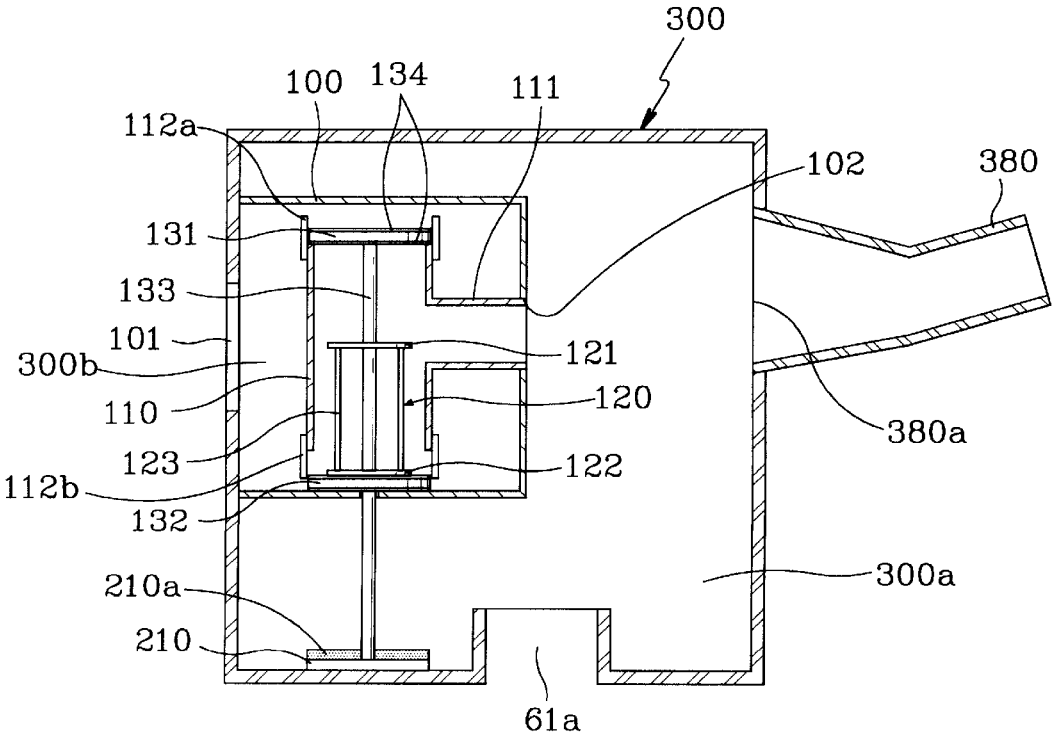
FIG. 9 illustrates a cross section of a bedding suction nozzle for a vacuum cleaner in accordance with a second preferred embodiment of the present invention.

The second embodiment of the present invention will be explained with reference to FIG. 9. Components identical to those of the first embodiment will be given the same names and reference numerals, and explanations of those components will be omitted.

A lower end of the connecting shaft 133 in the vibrating member 130 is extended to penetrate through a bottom of the housing 100 up to a vibration plate 210 which is fixed thereto. There is preferably a sound absorbing/vibration damping material 210*a* fitted on an upper surface of the vibration plate 210. The connecting shaft 133 should be extended enough so that the bottom of the vibration plate 210 comes into contact with the suction nozzle body 300 when the vibration member 130 is lowered fully.

The operation of the second embodiment of the present invention having the aforementioned system will be explained.

The vibration generating means 200 is put into operation by the suction force generated by the rotation of the fan mounted on the body of the vacuum cleaner during cleaning.

The operation principle is identical to the first embodiment. However, in the second embodiment, the vibration member 130 is designed to hit, not the housing 100, but the suction nozzle body 300, directly. That is, while the vibrating member 130 moves up and down, the vibration plate 210 also moves up and down. Therefore, the vibration plate 210 hits the suction nozzle body 300, directly. In this second embodiment, since not only the housing 100, but also the suction nozzle body 300 can be hit directly, a smooth vibration can be generated, allowing a smooth separation of various foreign matter from the surface of the bedding.

THIRD EMBODIMENT

Figure 10:
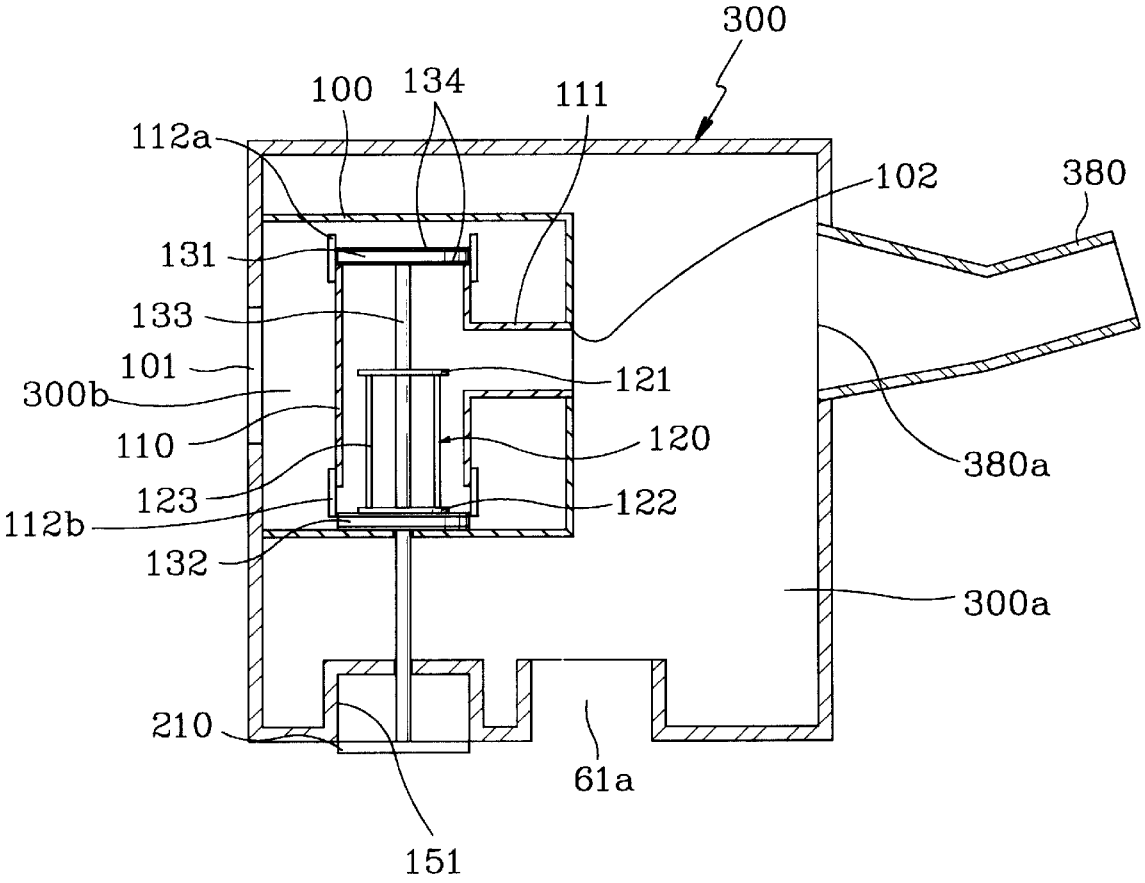
FIG. 10 illustrates a cross section of a bedding suction nozzle for a vacuum cleaner in accordance with a third preferred embodiment of the present invention.

Though an overall system of the third embodiment of the suction nozzle for a vacuum cleaner of the present invention is similar to the first, and second embodiments, the third embodiment has a system in which the surface of the bedding is vibrated, directly. A structure of the suction nozzle for a vacuum cleaner of the third embodiment will be explained with reference to FIG. 10. Explanations of components identical to the first and second embodiments will be omitted.

Recesses 151 are formed in the bottom of the suction nozzle body 300 along a longitudinal direction of the suction nozzle body 300. The connecting shaft 133 in the vibration member 130 is extended to penetrate a bottom of the suction nozzle body 300. A vibration plate 210, substantially in conformity with the recess 151, is fixed to the end of the connecting shaft 133. The vibration plate 210 is preferably located in front of the main suction hole 61*a* of the suction nozzle body 300. The operation of the third embodiment of the present invention is the same as the first, and second embodiments, expect that in the third embodiment, the vibration plate 210 at the end of the vibration member 130 hits the surface of the bedding, directly. Accordingly, various foreign matter, such as dust, which is stuck to the surface of the bedding, can be separated more effectively, thereby facilitating more efficient cleaning.

FOURTH EMBODIMENT

Figure 11A:
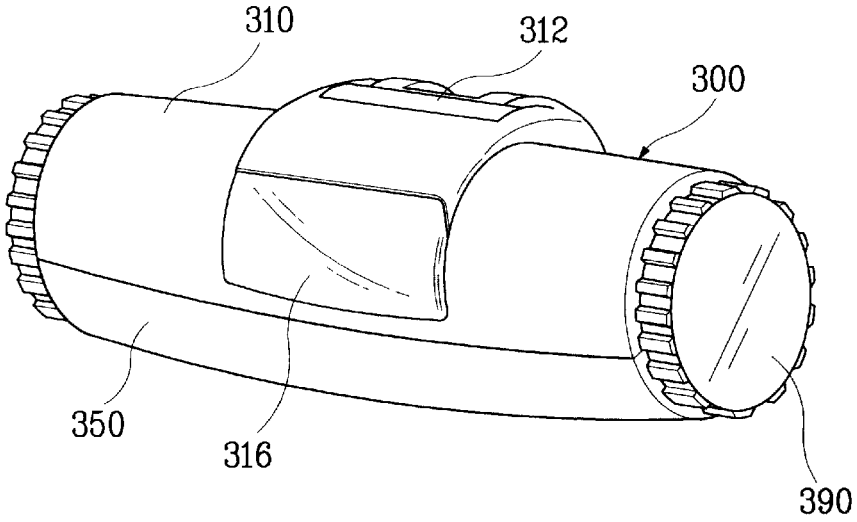
Figure 11B:
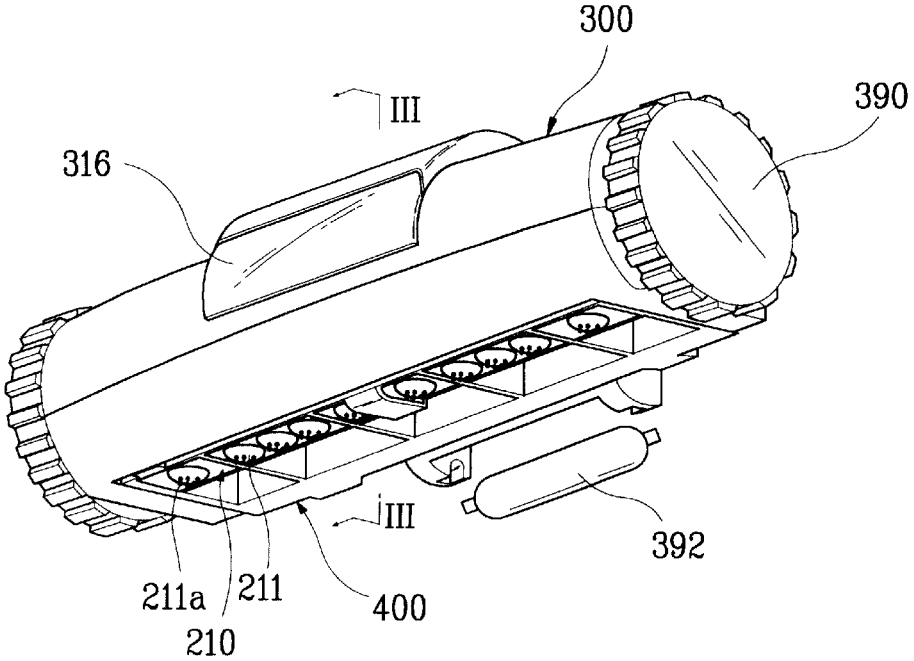
Figure 12:
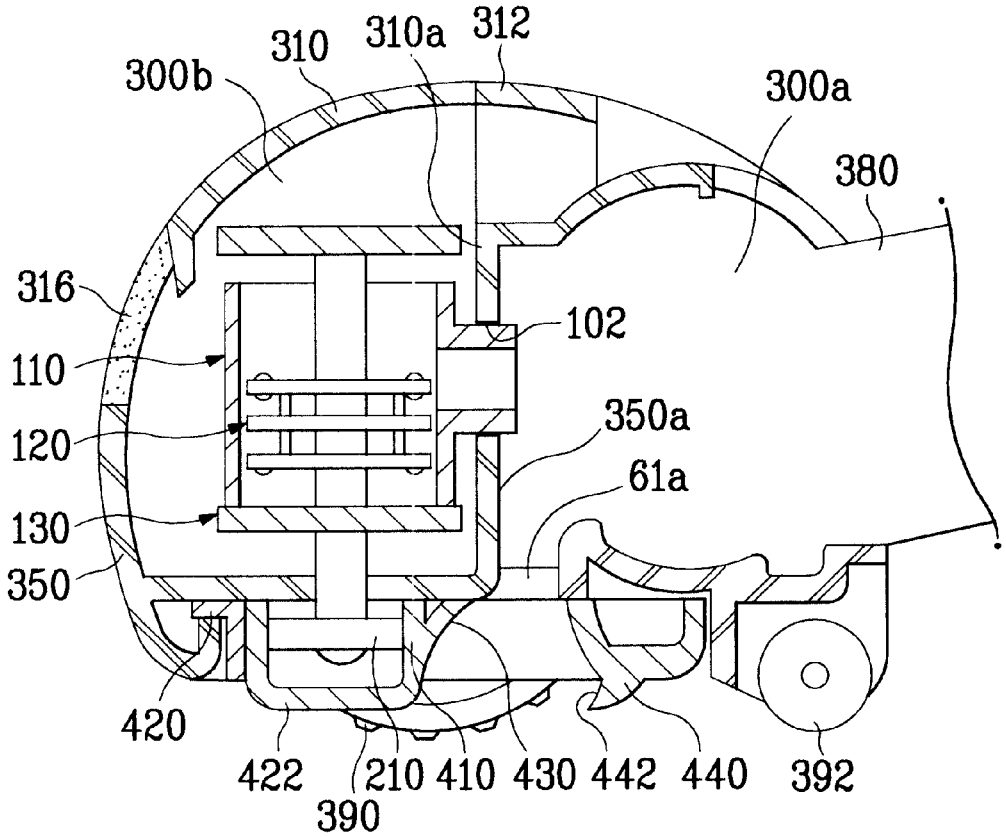
FIG. 12 illustrates a section across line III—III in FIG. 11B.

The fourth embodiment is a detailed version of the third embodiment. FIGS. 11A and 11B illustrate perspective views of a bedding suction nozzle for a vacuum cleaner in accordance with a fourth preferred embodiment of the present invention. FIG. 11A is a top perspective view, and FIG. 11B is a bottom perspective view. FIG. 12 illustrates a cross-section taken along line III—III in FIG. 11B. The fourth embodiment of the present invention will be explained with reference to FIGS. 11A, 11B and 12. Components identical to the third embodiment will be given the same reference numerals and names, and explanations of the same will be omitted.

In this fourth embodiment, a main air flow passage 300*a* and a supplementary air flow passage 300*b* are formed without using a separate housing for providing the main air flow passage 300*a* and the supplementary air flow passage 300*b* inside of the suction nozzle body 300. That is, an upper partition wall 310*a* is formed inside of an upper suction nozzle body 310 and a lower partition wall 350*a* formed inside of the lower suction nozzle body 350, for forming a main air flow passage 300*a* and a supplementary air flow passage 300*b*. The opening formed between the upper partition wall 310*a* and the lower partition wall 350*a* forms the opening 102 for communication of the main air flow passage 300*a* and the supplementary air flow passage 300*b*. A vibration generating means includes a duct 110, a moving member 120, and a vibrating member 130, which are mounted in the supplementary air flow passage 300*b*. Of course, the duct 110 is fitted such that the flow passage is in communication with the opening 102. And, like the third embodiment, a vibration plate 210 is fitted to a bottom surface of the suction nozzle body 300, to hit the bedding directly. The vibration plate 210 preferably has a plurality of projections 211 on a bottom surface thereof for more effective hitting of the bedding. More preferably, there are a plurality of supplementary projections 211*a* on a bottom surface of the projection 211. There is a cover 312 with a sound absorbing material, such as sponge 314*a*, detachably fitted to the supplementary suction hole 101 in the suction nozzle body 300. And, there is preferably a transparent window 316 for checking an operation state of the vibration generating means 200 in an appropriate location of the suction nozzle body 300.

The suction nozzle body 300 has wheels with projections 390 rotatably fitted at both sides thereof. And, a supplementary wheel with an appropriate diameter is preferably fitted to the bottom surface of the suction nozzle body 300, so that a fixed gap is provided between the bottom of the suction nozzle body 300 and the bedding. The supplementary wheel 392 preferably has a round cross-section for prevention of possible damage to the bedding. The supplementary wheel may also have a dumbbell form.

The bottom surface of the suction nozzle body 330, is brought into direct contact with a cleaning object, such as bedding, during cleaning. The object being cleaned is liable to have foreign matter, such as dust and hair stuck thereto. Therefore, it is preferable to fit a bottom plate 400 to the bottom of the suction nozzle body which is detachable for easy cleaning. The connection tube 380 at the rear of the suction nozzle body 300 is fitted such that a height and left and right side angles are adjustable for easy handling during cleaning and smooth operation.

Figure 13:
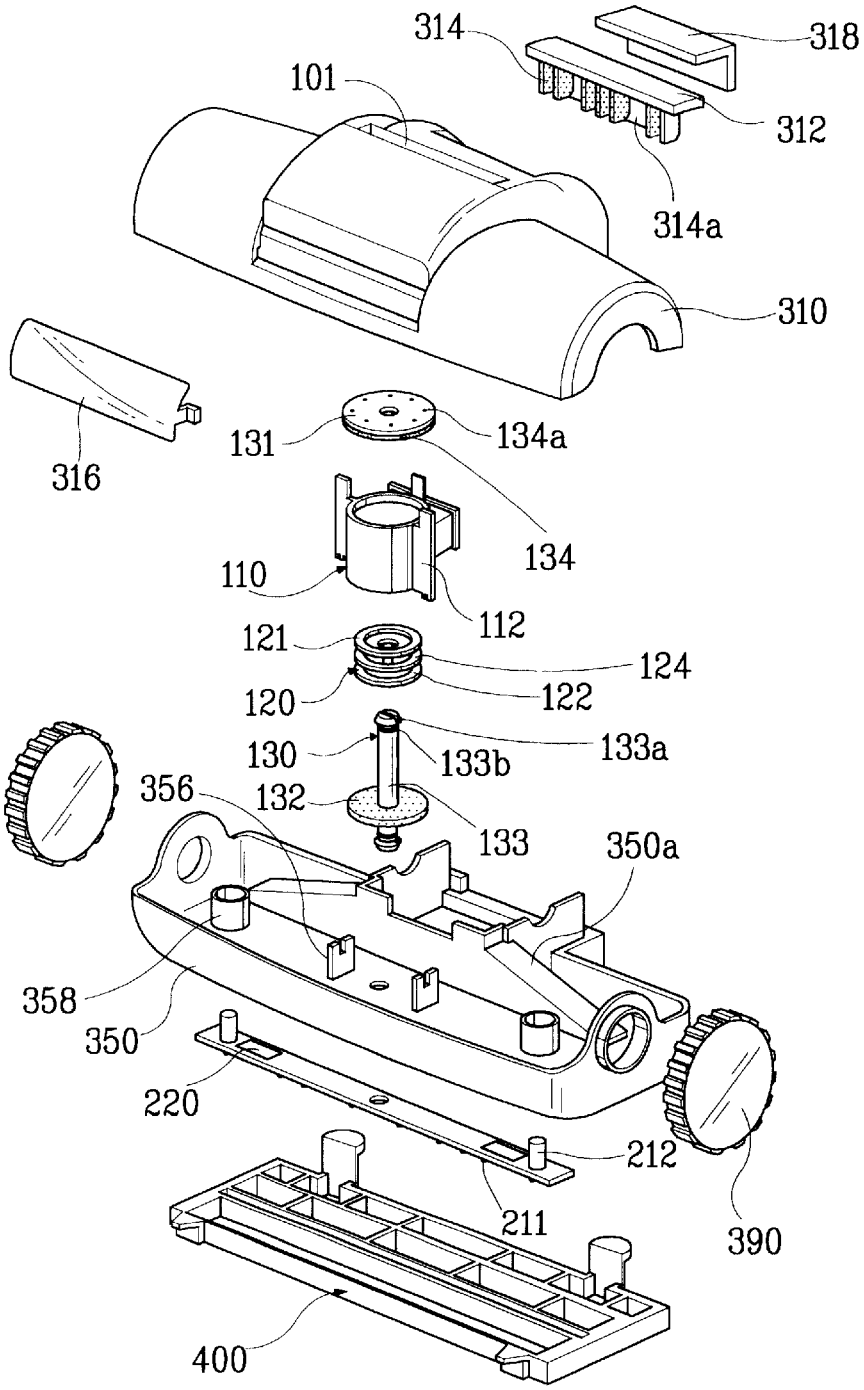
FIG. 13 illustrates a perspective disassembled view of FIG. 12.

The aforementioned components will be explained in detail with reference to FIG. 13.

The cover 312 is detachably fitted to the supplementary suction hole 101, and the cover 312 has sound absorbing material 314*a*, such as sponge fitted thereto for reducing noise generated in operation of the vibration generating means 200 and in filtering the dust and foreign matter in the air drawn through the supplementary suction hole 101. A cover 318 for opening/closing the cover 312 may be provided for opening or closing the supplementary air flow passage 300*b* as necessary for selective operation of the vibration generating means 200. The transparent window 316 permits a user to see the operation of the vibration generating means 200 from outside. This allows the user to determine whether the vibration generating means 200 is operating without disassembling the suction nozzle body 300. And, for better visibility, a convex lens may be provided to the transparent window 316, and a coat of fluorescent material may be applied to the vibration generating means 200. Alternatively, a lamp may be provided inside of the transparent window 316.

The duct 110 has the moving member 120 and the vibrating member 130 fitted thereto. The connecting shaft 133 has the upper cover 131 and the lower cover fixed thereto at top and bottom thereof, and the moving member 120 is disposed in the duct 110 for making up and down movement, guided by the connecting shaft 133. The vibration plate 210 is fixed to a bottom end of the connecting shaft 133.

The upper cover 131, the lower cover 132, and the vibration plate 210 may be fixed to the connecting shaft 133 with screws or adhesive. However, to improve the ease of assembly, it is preferable that a hook 133*a* be formed at the top end and the bottom end of the connecting shaft 133, respectively, and that a rib 133*b* be formed below each of the hooks 133*a* to prevent movement of the upper cover 131 and the lower cover 132. The hook 133*a* preferably has an outside diameter slightly greater than an outside diameter of the connecting shaft 133 with a cut off middle portion.

There are sound absorbing materials 134, such as non-woven fabric, on the upper cover 131 and the lower cover 132 of the vibration member 130. The sound absorbing material 134 is preferably fitted on a bottom surface of the upper cover 131 and a top surface of the lower cover 132. For convenience of assembly of the sound absorbing material 134, a plurality of projections 134*a* are preferably formed on one side of the upper cover 131 and the lower cover 132, for marking a direction.

There are guide pieces 112 formed on the outside of the duct 110, which are preferably supported by supporting members 356 on an inside surface of the suction nozzle body 300. Of course, supporting members may be formed on top and bottom, left and right, and/or front and rear of the duct 110 for more firm fixing of the duct 110. Also, the duct 110 and the suction nozzle body 300 may be formed as a unit.

The vibration plate 210 is located on the bottom surface of the suction nozzle body 300. It is preferable that a plurality of hollow guiding members 358 are formed inside of the lower body 300 and a plurality of projections 212 are formed on the vibration plate 210 for being guided by the hollow guiding members 358. This configuration allows the vibration plate 210 to move upward and downward without moving in left and right directions. Projections may also be formed on the bottom surface of the suction nozzle body 300 and guiding members may be formed on a top surface of the vibration plate 210 for guiding the vibration plates. A plurality of sound absorbing material pieces 220 are fitted to the top surface of the vibration plate 210 or to the bottom surface of the suction nozzle body 300 for reducing noise and impact generated when the vibration plate 210 hits the suction nozzle body 300. And, more preferably, an elastic member (not shown), such as a spring, may be mounted on the bottom surface of the suction nozzle body 300 for amplifying the vibration generated from the up and down movement of the vibration plate 210 as well as reducing the noise.

Figure 14A:
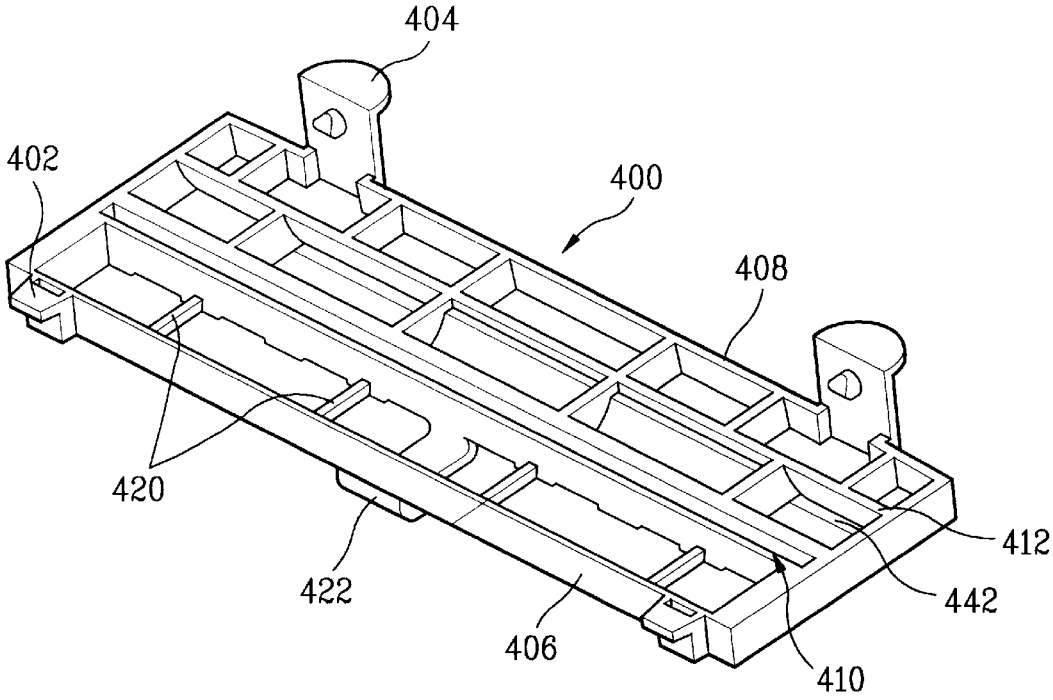
Figure 14B:
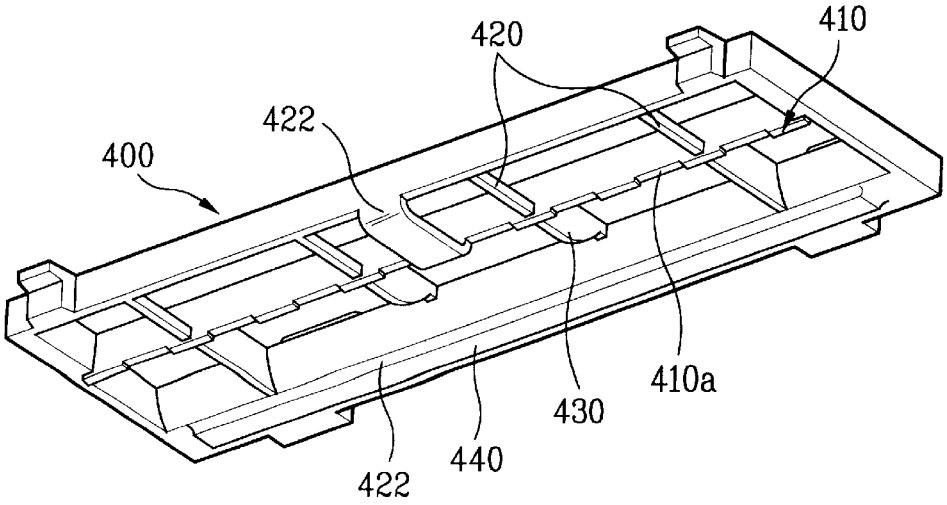

The bottom plate 400 will be explained with reference to FIGS. 12, 14A and 14B.

The bottom plate 400 has substantially a rectangular form in conformity with the recess 151 in the bottom surface of the suction nozzle body 300, and is provided with catch projections 402 and 404. The catch projections 402 and 404 are inserted into holes in the suction nozzle body 300, so that the bottom plate 400 is coupled to the suction nozzle body 300. There is a first longitudinal member 410 and a second longitudinal member 412 corresponding to a long side of the recess 151 in the body 300 inside of the bottom plate 400. The vibration plate 210 is disposed in spaces formed between a front portion 406 of the bottom plate 400 and the first longitudinal member 410, and the main suction hole 61*a* of the body 300 is disposed above spaces formed between the first longitudinal member 410 and the second longitudinal member 412. In order to prevent the vibration plate 210 from being caught by the bedding, which may stop the operation of the vibration plate 210, a plurality of transverse members 420 are formed between the front portion 406 of the bottom plate 400 and the first longitudinal member 410. A projected transverse member 422 is formed at a center thereof.

The first longitudinal member 410 preferably has recesses 410*a* formed at a bottom thereof, providing an uneven structure in the bottom surface, for reducing friction caused when the bottom surface of the body 300 and the bedding are in contact during cleaning. There are a plurality of supporting portions 430 behind the first longitudinal member 410, preferably with a curve for reducing friction between the bottom surface of the body 300 and the bedding during cleaning. A projected rib 440 extends in the longitudinal direction on the bottom of the second longitudinal member 412. A recess 442 also extends in the longitudinal direction. The rib 440 and recess 442 help to prevent the bedding from being drawn into the main suction hole 61*a*. The recess 442 also helps to remove pieces of thread and hair. Coats of an antimicrobial agent and an antistatic agent are preferably applied to the bottom plate 400. And, as can be seen from FIG. 12, the rib 440 in front of the second longitudinal member 412 concentrates the suction force of the suction nozzle from floor toward the main suction hole 61*a*, which further improves the cleaning performance. The foregoing bottom plate 400 may be applied to other suction nozzles, other than for bedding.

Figure 15A:
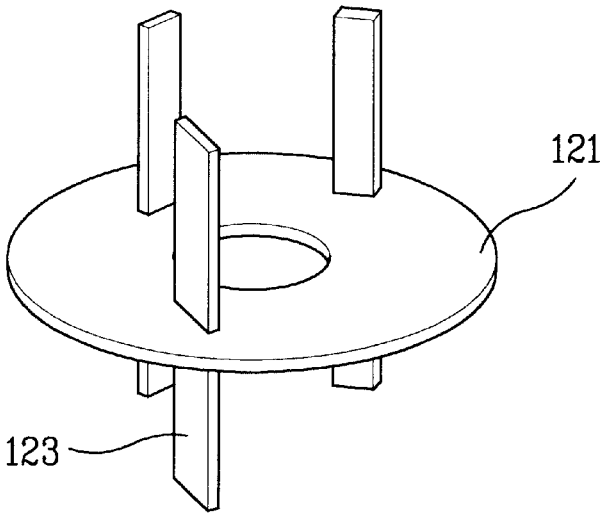
FIGS. 15A–15F respectively illustrate perspective views of modified versions of the moving member shown in FIG. 13.
Figure 15B:
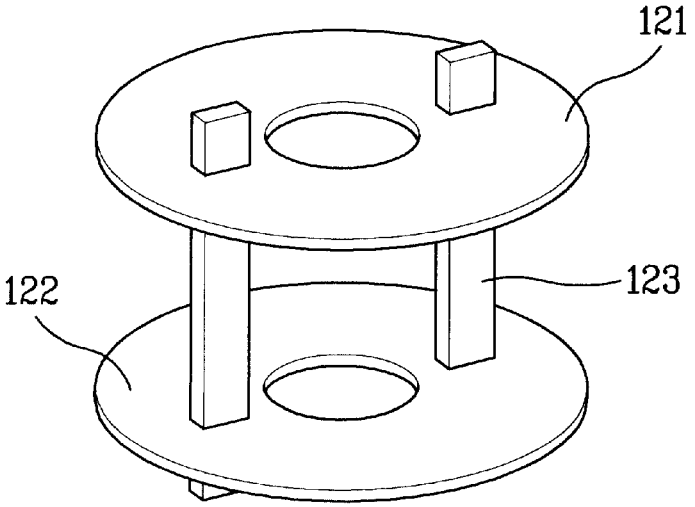
Figure 15C:
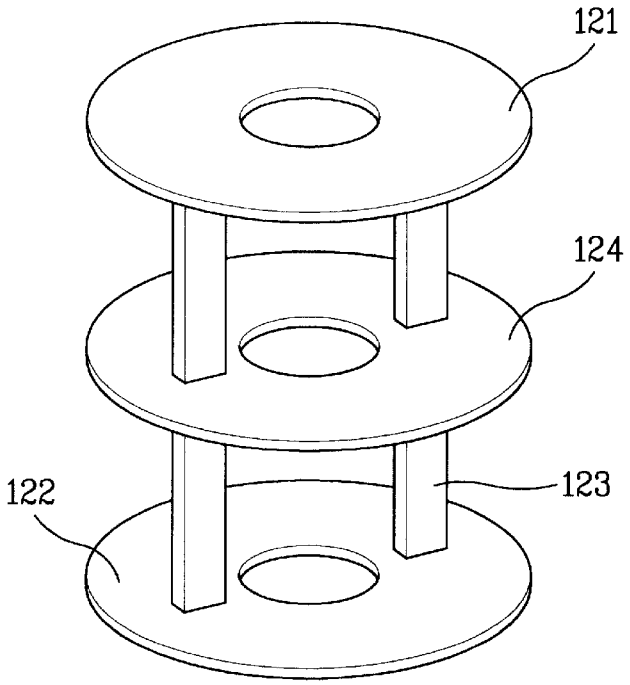
Figure 15D:
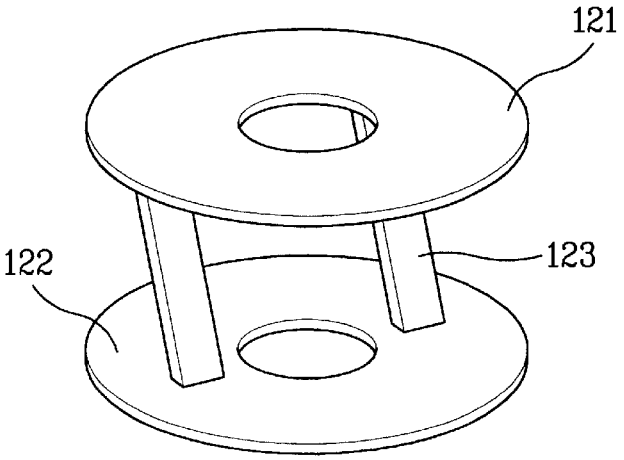
Figure 15E:
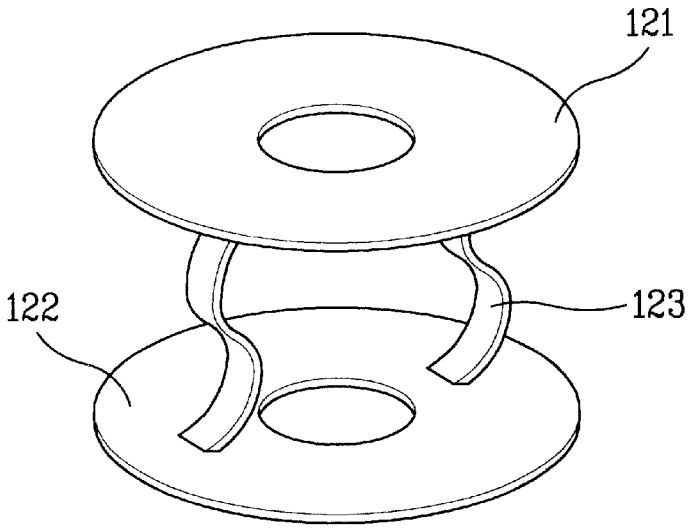
Figure 15F:
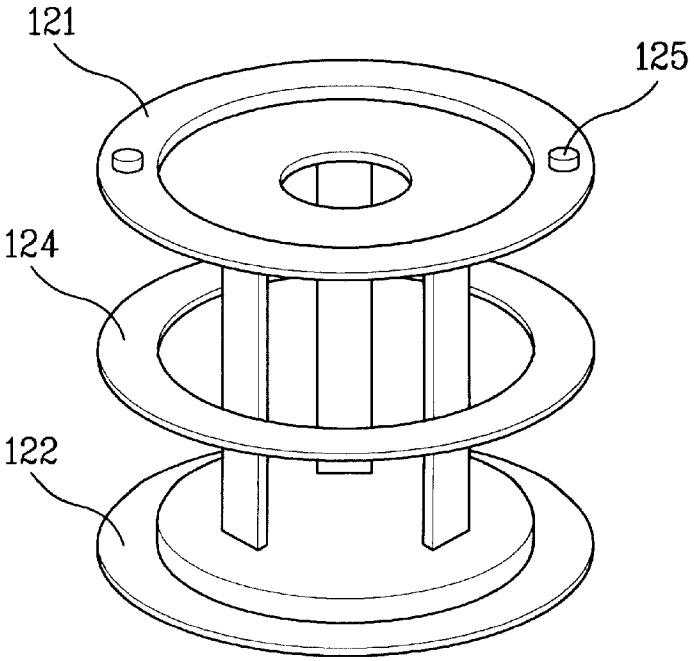

The moving member 120 of the present invention will be explained in detail with reference to FIGS. 15A–15F. The moving members explained up to now have two or three plates, but the number of the plates is not limited to this. That is, as shown in FIGS. 5A to 5C, at least one moving plate 121 or 122 can do the function. As shown in FIG. 15E, the connecting members 123 may not be straight, but rather could be curved, for exerting a rotation force on the moving member 120. As shown in FIGS. 15A and 15B, the connecting members 123 may be projected above the upper surface and below the lower surface of the upper plate and the lower plate 121 and 122, respectively. As shown in FIG. 15F, separate projections 125 may be formed to improve impact. And, as shown in FIG. 15F, the upper plate 121 and the lower plate 122 may be formed with a central recess and a plurality of projections 125 on an annular rim out of the recess, for improving the impact.

Figure 16A:
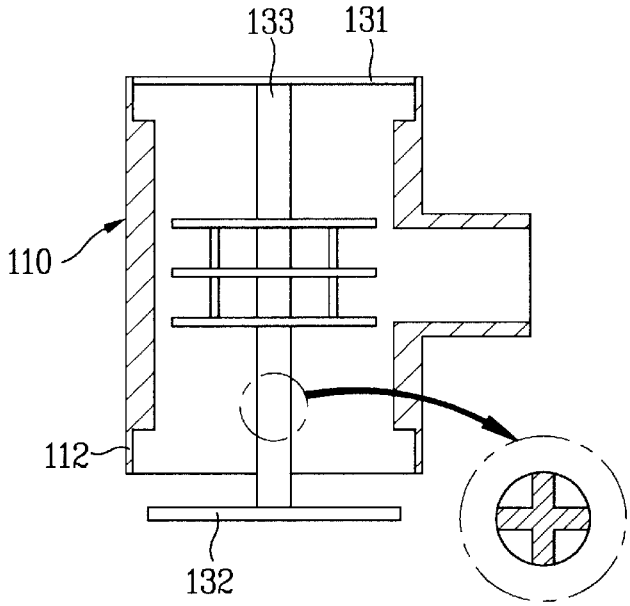
FIGS. 16A–16C respectively illustrate cross sections of modified versions of the vibrator supporting structures shown in FIG. 13.
Figure 16B:
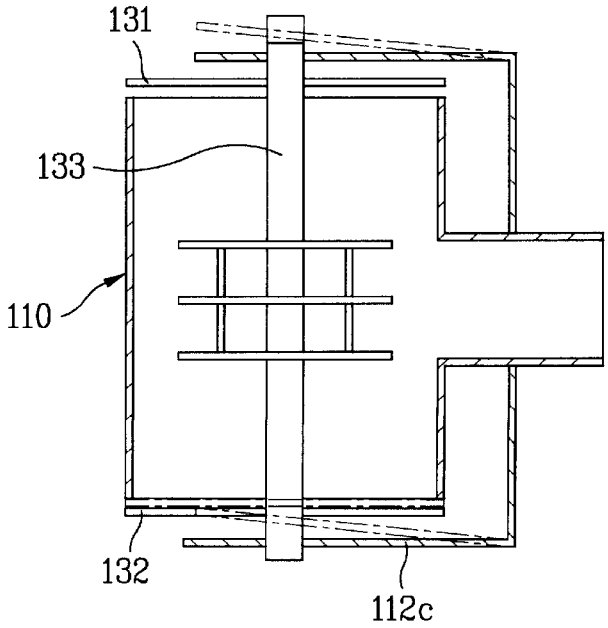
Figure 16C:
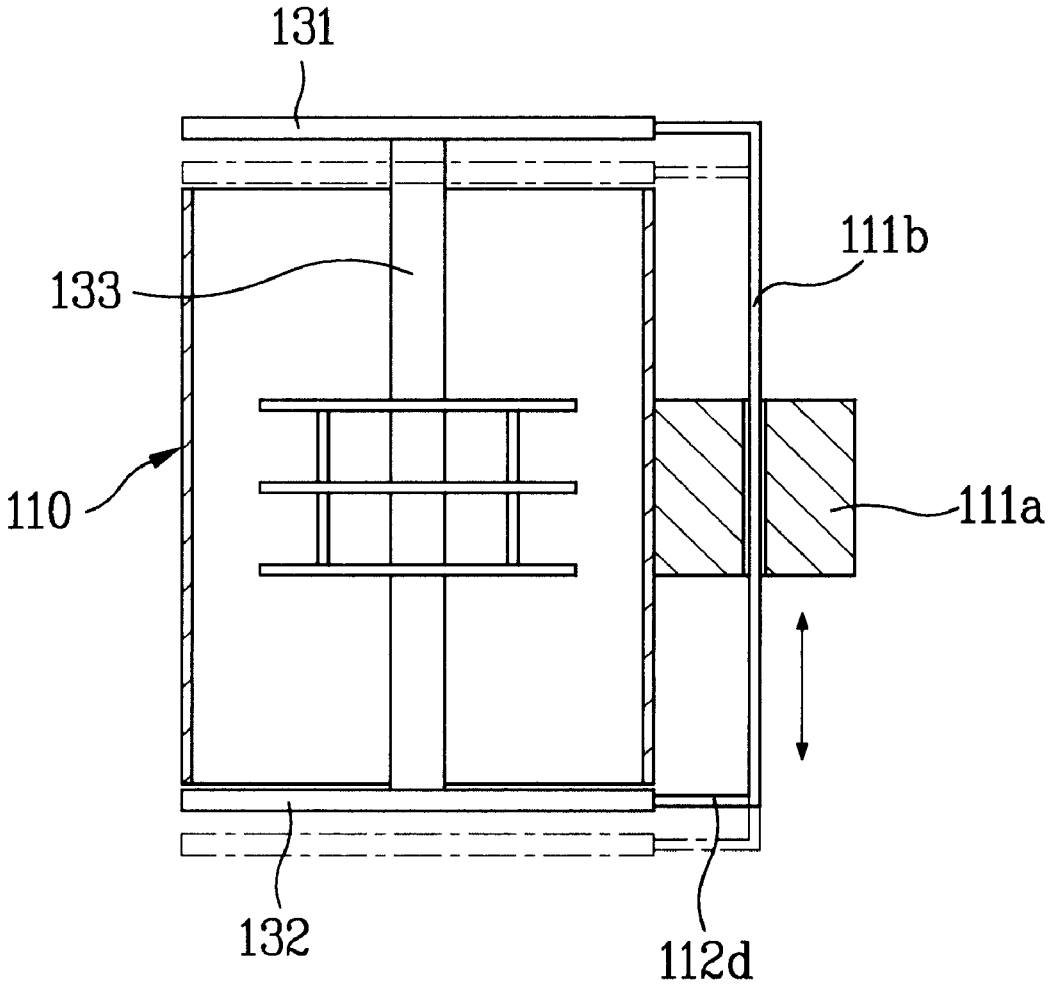

Modified versions of the guiding system for the vibration member 130 will be explained with reference to FIGS. 16A to 16C. As shown in FIG. 16A, the vibration member 130 is guided by the guide pieces 112 on an outside surface of the duct 110. However, as shown in FIG. 16B, the connecting shaft 133 may be extended in up and down directions for using a guide member 112*c*, one end of which is coupled to both ends of the connecting shaft 133, and the other end of which is connected to the flow passage of the duct 110. The guide member 112*c* is formed of an elastic material. As shown in FIG. 16C, when the guide member 112*d* is formed of a non-elastic material, the guide member 112*d* is formed to be movable in up and down directions. That is, a supporting portion 111*a* with a guide hole 111*b* is provided at one side of the duct 110, for guiding the guide member 112*d* along the guide hole 111*b*. And, as shown in FIG. 16A, the connecting shaft 133 preferably has a circular section with a plurality of recesses for reducing friction.

Figure 17:
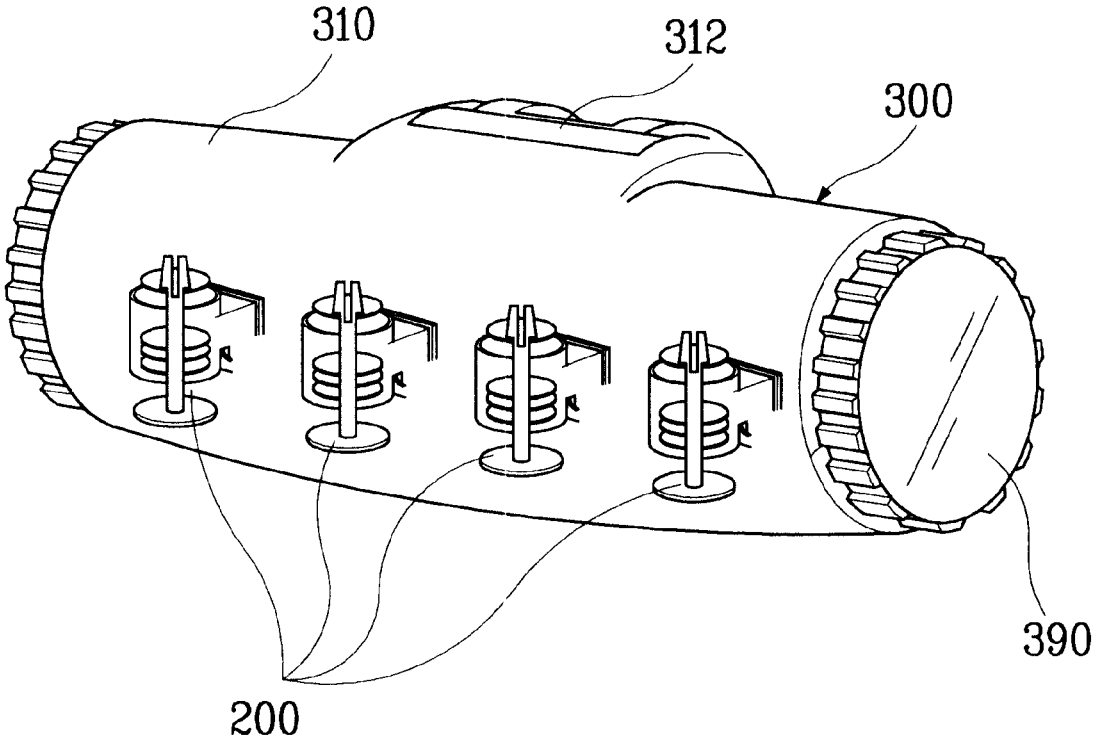
FIG. 17 illustrates a perspective view of a modified version of FIG. 13, schematically.
Figure 18:
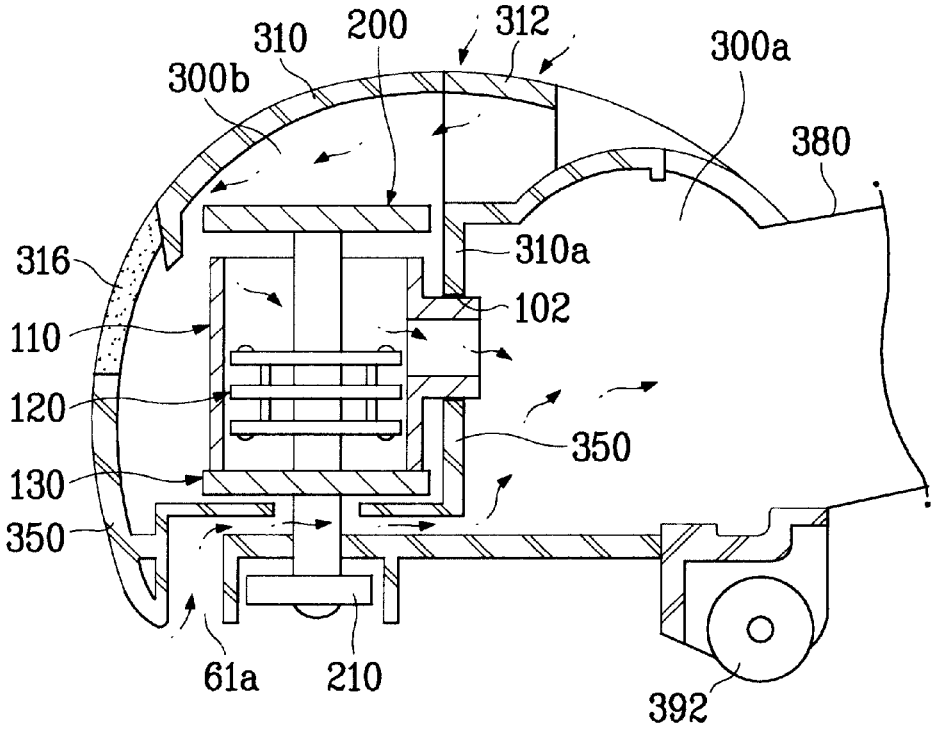
FIGS. 18 and 19 respectively illustrate cross sections showing modified versions of the suction nozzle body shown in FIG. 13.
Figure 19:
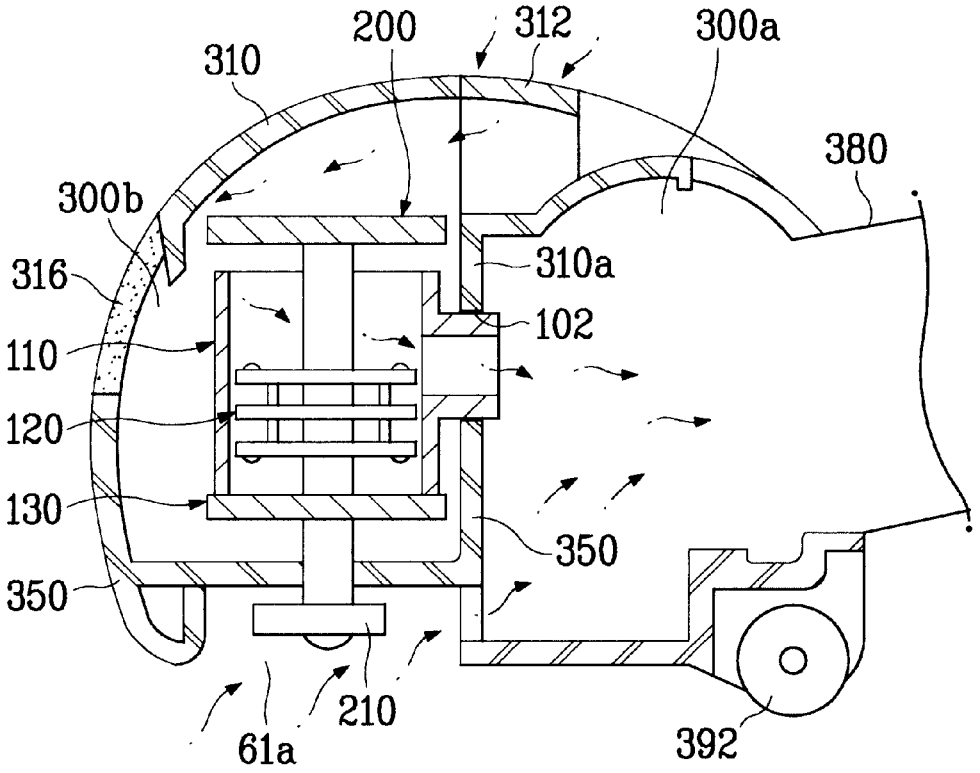

Embodiments explained up to now have the vibration plate 210 disposed in front of the main suction hole 61*a*. However, the present invention is not limited to this. As shown in FIG. 18, the vibration plate 210 may be disposed behind the main suction hole 61*a*. As shown in FIG. 19, the vibration plate 210 may be disposed immediately adjacent the main suction hole 61*a*. As shown in FIG. 17, a plurality of the vibration generating means 200 may be provided in the supplementary air flow passage 300*b*. The plurality of the vibration generating means 200 may be mounted either in one supplementary air flow passage 300*b*, or a vibration generating means 200 may be mounted in each of a plurality of supplementary air flow passages 300*b*. This system improves a reliability of the vibration generating means because the vibration generating means will be operative even if one of the vibration generating means 200 becomes inoperative.

FIFTH EMBODIMENT

Figure 20:
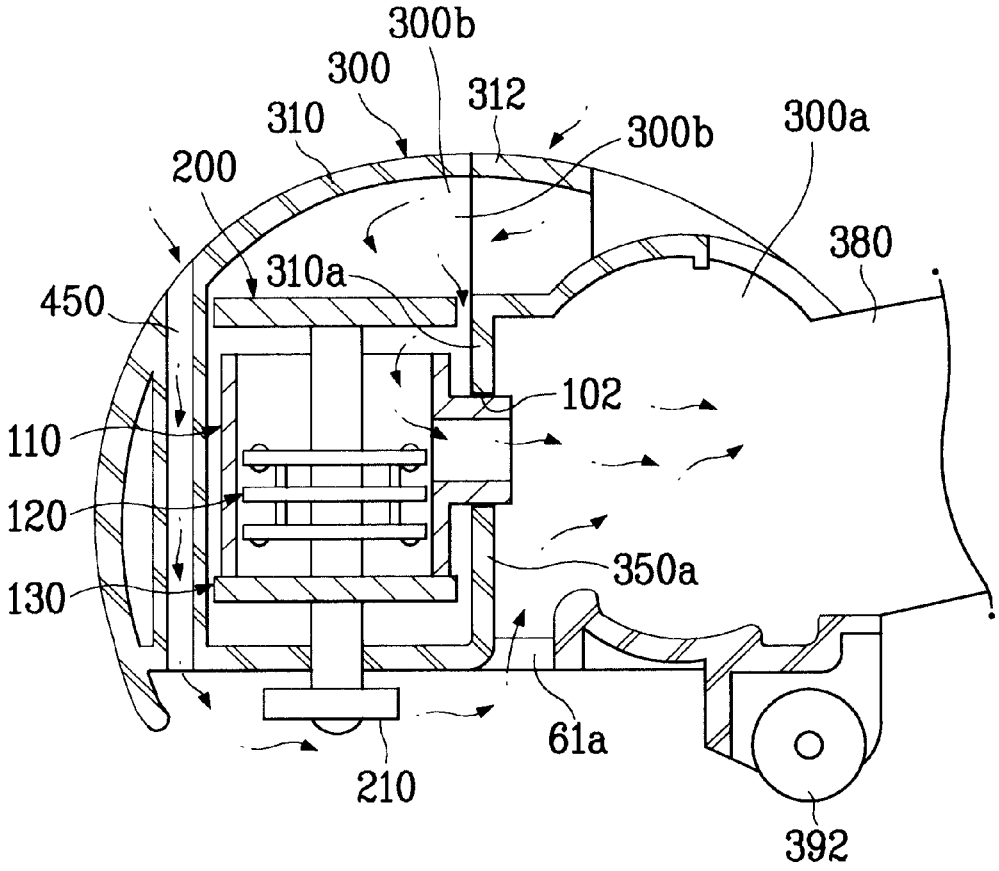
FIG. 20 illustrates a cross section of a suction nozzle for a vacuum cleaner in accordance with a fifth preferred embodiment of the present invention.

The fifth embodiment is a further modified version of the foregoing embodiments, wherein a suction nozzle for a vacuum cleaner is provided in which means for separating foreign matter stuck to the bedding is further added to the vibration generating means, for effective separation of the dust stuck to the bedding. FIG. 20 schematically illustrates a cross section of a suction nozzle for a vacuum cleaner in accordance with a fifth preferred embodiment of the present invention, referring to which the fifth embodiment will be explained. Components identical to the aforementioned embodiments will be given the same name and reference numerals, and explanations on the same will be omitted.

There is a blast air flow passage 450 passing through the bottom to the top of the body 300 of the suction nozzle body 300. A lower end of the blast air flow passage 450 is formed at the bottom of the suction nozzle body 300, and an upper end is formed at a location other than the bottom surface. This system draws external air through the supplementary suction hole 101 by the suction force generated when the vacuum cleaner is put into operation, to drive the vibration generating means 200. Also, external air is drawn into the blast air flow passage 450 by the suction force, and blasted onto a floor below the suction nozzle body 300. Accordingly, as the bedding is hit by the vibration generating means 200 as well as blasted by an airflow passing through the blast air flow passage 450, any foreign matter stuck to the bedding is separated more effectively. Accordingly, this embodiment provides a more effective cleaning of the bedding compared to a suction nozzle with only the vibration generating means 200.

Figure 21:
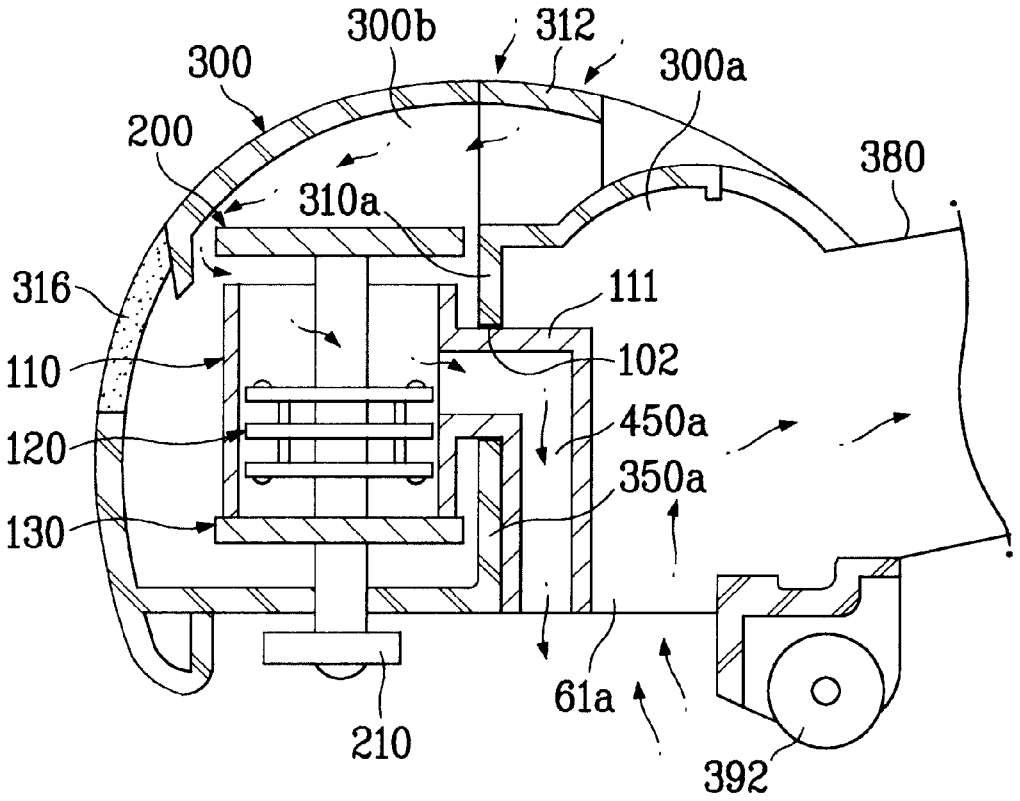
FIG. 21 illustrates a cross section showing a modified version of FIG. 20.

In an alternative embodiment, as shown in FIG. 21, air coming through the supplementary air flow passage may be blasted through the bottom surface of the suction nozzle body 300 by connecting the opening 102, to the blast air flow passage 450*a*.

Figure 22A:
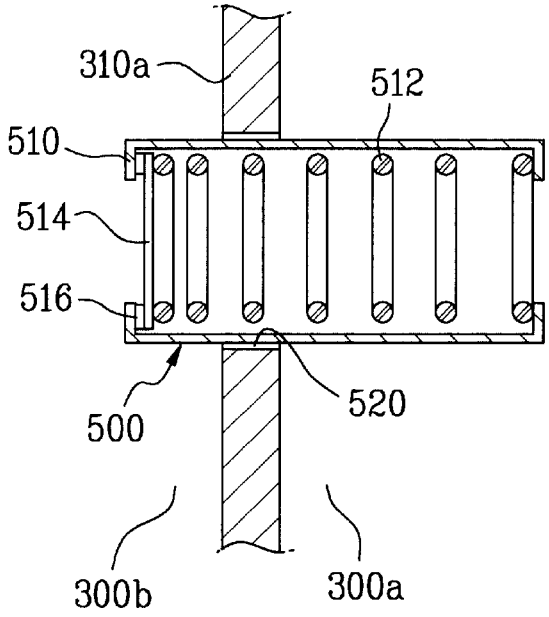
FIGS. 22A and 22B illustrate cross sections of a suction nozzle for a vacuum cleaner in accordance with a sixth preferred embodiment of the present invention.
Figure 22B:
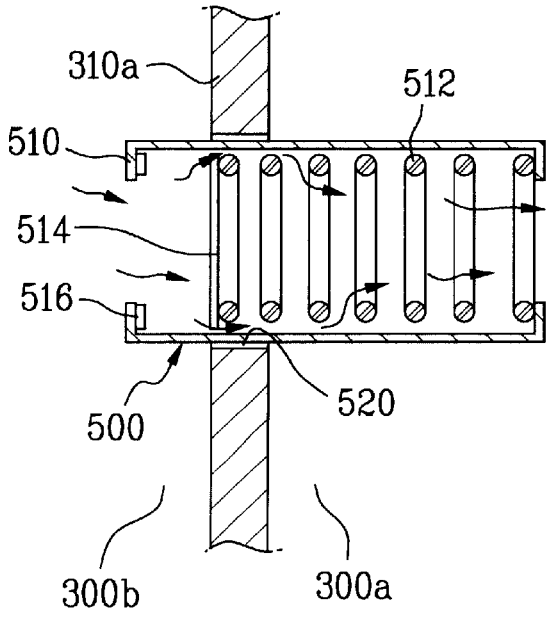

The aforementioned embodiments have a possibility of damage to the suction nozzle when the suction nozzle is overloaded due to blockage of the main suction hole by the bedding. Two overload protection devices for use with any of the foregoing embodiments will now be described. FIGS. 22A and 22B illustrate cross sections of the overload protection devices of the present invention.

There is an opening 520 in the upper partition wall 310*a* of the suction nozzle body 300, in which the overload protection device 500 is mounted. The first type of overload protection device 500, as shown in FIGS. 22A and 22B, is mounted in the opening 520. The overload protection device includes a case 510 having openings at both ends, an elastic member, for example, a coil spring 512, disposed in the case 510, and a cover 514 at a fore end of the spring 512. A packing 516 of soft rubber is preferably fitted to an inside of the opening at the fore end of the spring 512 for better shut off of the fore end opening of the case 510 by the cover 514. The spring has a modulus of elasticity selected based on the suction pressure of the vacuum cleaner, and the cover 514 should have a diameter smaller than an inside diameter of the case 510, but greater than the opening of the case 510.

The operation of the aforementioned overload protection device will be explained.

During normal operation of the vacuum cleaner, the air drawn through the supplementary suction hole can not compress the spring 512 in the overload protection device 500 since the device is not overloaded. Accordingly, the vacuum cleaner is operative the same as before as in the foregoing embodiments. However, when the main suction hole is blocked by the bedding, the external air flows only through the supplementary suction hole at a high pressure, which overloads the device. In this instance, the suction force in the supplementary passage overcomes the elastic force of the spring 512 in the overload protection device 500. As shown in FIG. 22B, the cover 514, overcoming the elastic force of the spring 512, moves backward, opening the fore end of the case 510. Then, the air flows to the rear of the case 510 through a gap between an inside surface of the case 510 and the cover 514, and, eventfully, to the body of the vacuum cleaner through the main air flow passage 300*a*. When the overloaded state ends, the spring 512 returns to its original position, cutting off the air flow, to put the vacuum cleaner back into its normal operating state.

Figure 23A:
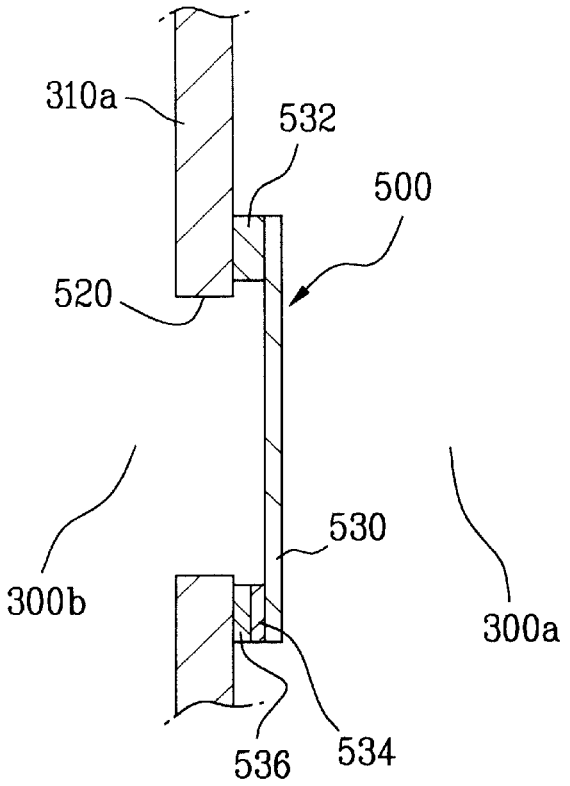
FIG. 23A and 23B respectively illustrate cross sections showing modified versions of FIG. 22A.
Figure 23B:
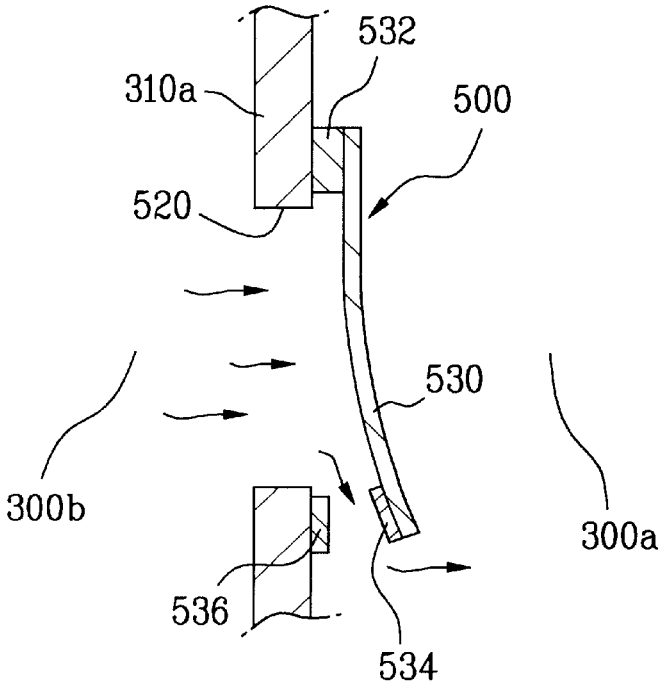

Another embodiment of the overload protection device will be explained with reference to FIGS. 23A and 23B. In this device, a flap 530 of elastic material is fitted to the upper partition wall 310*a* on an outside thereof for selective opening/closing of the opening 520. That is, one side of the flap 530 is fixed to a place above the opening 520 and the other side is at a close contact with a place below the opening 520. The fixture of the flap 530 to a place above the opening 520 is done preferably with a sealing member placed in between, and rubber packings 534 and 536 are preferably attached to an inside of the flap 530 below the opening 520, and to an outside of the upper partition wall 310*a*. In this system, when an air pressure in the supplementary air flow passage 300*b* exceeds a certain pressure, the air pressure overcomes the elastic force of the flap 530 and pushes the flap 530. As the flap 530 is fixed at the upper side while the lower portion is not fixed, the lower portion is opened, allowing the air to escape through the opened gap. When the pressure drops below a certain value, the flap 530 returns to its original position, closing the opening. Though this embodiment suggests mounting of the overload protection device 500 in the upper partition wall 310*a*, the present invention is not limited to this embodiment. That is, mounting of the overload protection device 500 in the supplementary air flow passage 300*b* can do the required service. Therefore, the overload protection device 500 can be mounted in the lower partition wall 350*a*, or in the housing in a case of a structure in which a separate housing is provided.

SIXTH EMBODIMENT

Figure 24:
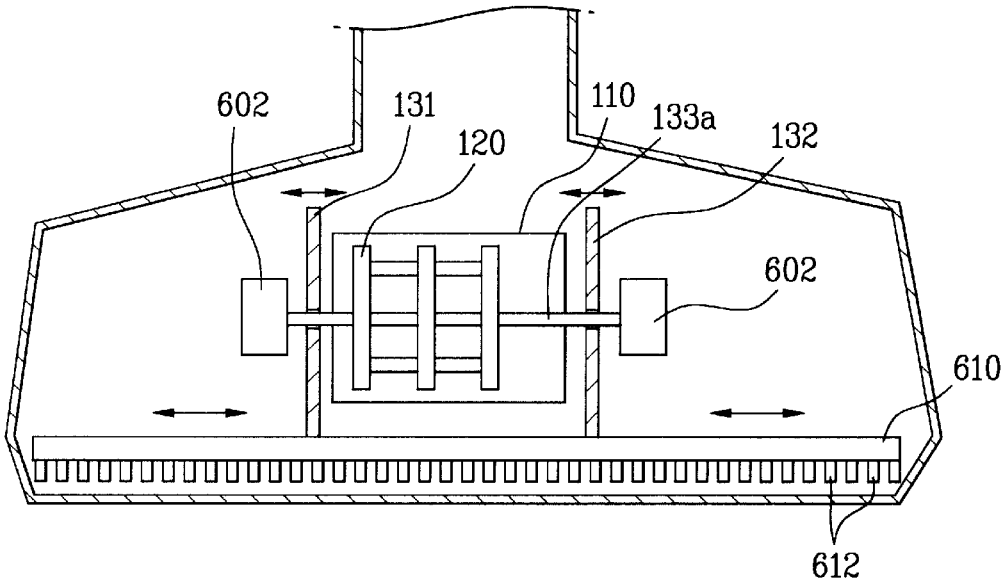
FIG. 24 schematically illustrates a cross section of a suction nozzle for a vacuum cleaner in accordance with a seventh preferred embodiment of the present invention.

This embodiment has the same operation principle as the aforementioned embodiments, except that the vibration generating means of this embodiment is mounted in a horizontal configuration. FIG. 24 schematically illustrates a cross section of a suction nozzle for a vacuum cleaner in accordance with this embodiment.

Like the aforementioned embodiments, the vibration generating means 200 is mounted in a supplementary air flow passage 300*b*. The duct 110 is fitted horizontally, and there are pedestals 602 on left and right sides of the duct 110, for supporting the connecting shaft 133*a*. There is a moving member in the duct 110 through which the connecting shaft 133 passes. The moving member 120 has an upper cover 131 and a lower cover 132 on left and right sides, through which the connecting shaft 133 passes. The moving member 120, the upper cover 131, and the lower cover 132 are slidably mounted on the connecting shaft 133, and there is a moving plate 610 attached to the upper plate 131 and the lower plate 132. That is, in this embodiment, the connecting shaft 133*a* does not move, but the upper plate 131 and the lower plate 132 is moved in left and right directions by the left and right direction movement of the moving member 120, according to which the moving plate 610 moves in left and right directions. A brush 612 or a duster may be fitted to a bottom surface of the moving plate 610 as necessary.

The operation of the aforementioned suction nozzle for a vacuum cleaner will be explained. When the vacuum cleaner is put into operation, a suction force is generated and the vibration generating means 200 is driven. The moving member 120, moving in left and right directions, hits the upper plate 131 and the lower plate 132, to move the upper plate 131 and the lower plate 132 in the left and light directions. Eventually, the moving plate 610 attached to the upper plate 131 and the lower plate 132 is also moved in the left and right directions. If the brush 612 or the duster is fitted to the bottom of the moving plate 610, the bedding can be brushed or dusted, which allows more effective cleaning. As an alternative to this embodiment, the vibration generating means 200 may be mounted at a right angle to the present position, to move the moving plate 610 in forward and backward directions.

SEVENTH EMBODIMENT

This embodiment provides an automatic massage device and an automatic striking device using the vibration generating means of the present invention. Because the vacuum cleaner is generally used for cleaning only once per day or once every few days, this embodiment is designed to improve a usage of the vacuum cleaner.

Figure 25:
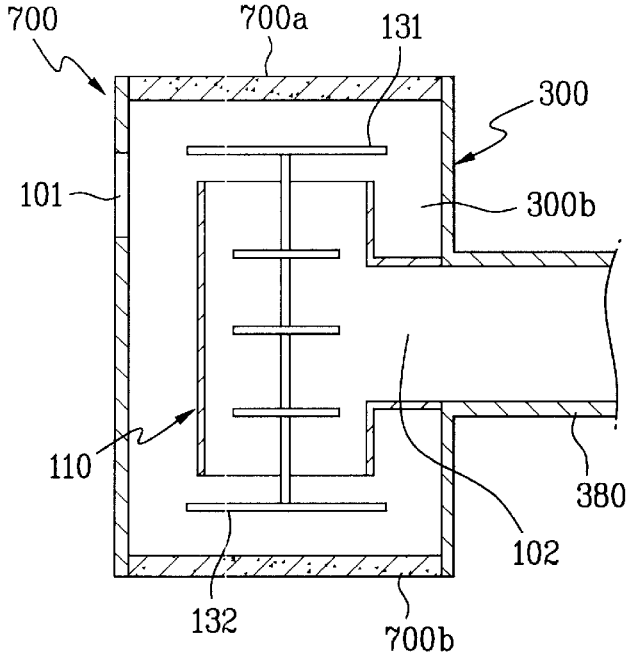
FIG. 25 illustrates a cross section of a suction nozzle for a vacuum cleaner in accordance with an eighth preferred embodiment of the present invention; and, FIG. 26 illustrates a cross section of a variation of the suction nozzle for a vacuum cleaner in accordance with the eighth preferred embodiment of the present invention.

FIG. 25 illustrates the seventh embodiment, referring to which the automatic massage device will be explained. The massage device 700 includes the body 300 having a supplementary air flow passage 300*b* and a vibration generating means 200 mounted in the body 300. That is, the body 300 has a supplementary suction hole 101 and an opening 102 only. A connection tube 380 is coupled to one side of the opening 102, and the connection tube 380 is coupled to a suction hose(not shown). This embodiment also has a vibration generating means 200 identical to the aforementioned embodiments. Meanwhile, an upper surface 700*a* and a lower surface 700*b* of the body 300 are formed of an elastic material, for soft transmission of vibration from the upper plate 131 and the lower plate 132.

The operation of the automatic massage device will be explained with reference to FIG. 25. In order to use the massage device, the connection tube 380 is connected to the suction hose of the vacuum cleaner, and the vacuum cleaner is put into operation. Then, the vibration generating means 200 is driven by a suction force generated from the vacuum cleaner. According to this, the upper plate 131 and the lower plate 132 strike the upper surface 700*a* and the lower surface 700*b* of the body 300. Therefore, if the upper surface 700*a* or the lower surface 700*b* of the body 300 is brought into contact with a portion to be massaged, the massage is done, automatically.

Figure 26:
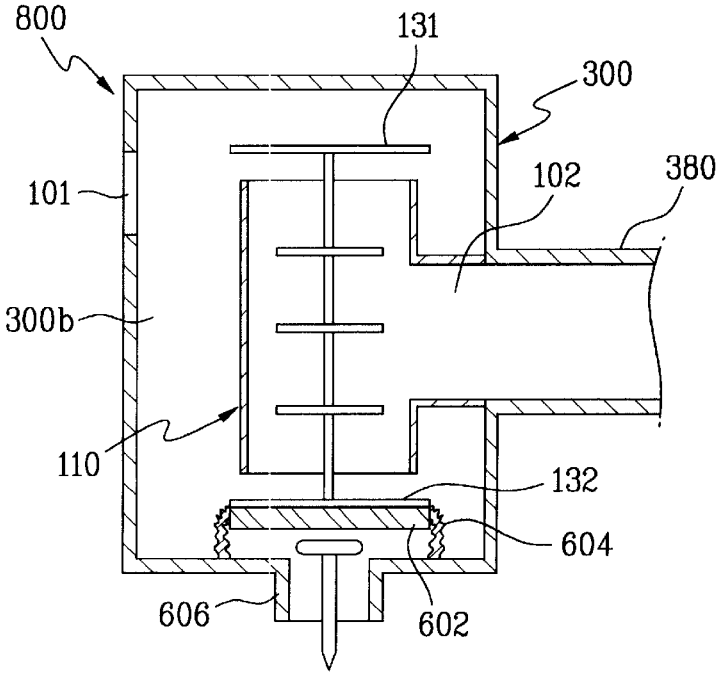

Being a variation of the device shown in FIG. 25, FIG. 26 illustrates an automatic striking device, which will be explained. An overall system of the automatic striking device 800 is similar to the foregoing automatic massage device 700, except the lower cover 132 has an opening with a supporting rim 606 around it for guiding a nail and the like, for striking the nail and the like. A striking member 602 of a high strength material is preferably fitted to the bottom of the lower cover 132. There is a bellows 604 provided between the lower cover 132 and the body 300 for prevention of air leakage during the up and down movement of the lower cover 132. When a nail is placed in the supporting rim 606 on the bottom of the body 300 and the vacuum cleaner is put into operation, the vibration generating means 200 is driven, driving the nail. Though a suction force from the vacuum cleaner is employed for driving the automatic massage device or the striking device in this embodiment, a separate suction force generating device may be used.

The suction nozzle for a vacuum cleaner of the present invention as explained has the following advantages.

First, the separation of dust from surfaces of bedding by the striking of the vibration generating means driven by air drawn from outside of the vacuum cleaner, and the subsequent suction of the dust separated from the bedding, and floated dusts through the main, and supplementary suction holes improves convenience of the vacuum cleaner usage as no direct shaking off of the bedding by the user is required.

Second, the generation of a harder striking effect of the vibration generating means caused by drawing in of the more external air through the supplementary suction hole in the housing when the bedding blocks the main suction hole in the suction nozzle body facilitates an easy separation of the main suction hole from a surface of the bedding and a better separation of the various foreign matters, such as dust and the like, stuck to the surface of the bedding, which improves cleaning efficiency.

It will be apparent to those skilled in the art that various modifications and variations can be made in the suction nozzle for a vacuum cleaner of the present invention without departing from the spirit or scope of the invention. Thus, it is intended that the present invention cover the modifications and variations of this invention provided they come within the scope of the appended claims and their equivalents.

What is claimed is:

1. A suction nozzle for a vacuum cleaner, comprising:

a suction nozzle body including:

a main suction hole for drawing external air into the suction nozzle body, a discharge hole for providing air drawn into the suction nozzle body to a main body of a vacuum cleaner, and a supplementary suction hole for drawing external air into the suction nozzle body, wherein a main air flow passage is formed between the main suction hole and the discharge hole, and wherein a supplementary air flow passage is formed between the supplementary suction hole and the main air flow passage; and, a vibration generating device mounted in the supplementary air flow passage, wherein the vibration generating device is configured to generate a vibrating force in response to an air flow drawn through the supplementary suction hole, wherein the vibration generating device comprises a duct and a vibrating member configured for reciprocal movement within the duct.

2. A suction nozzle as claimed in claim 1, wherein the supplementary air flow passage includes a housing, having:

a first opening that is in communication with the supplementary suction hole, and a second opening that is in communication with the main air flow passage.

3. A suction nozzle as claimed in claim 2, wherein the duct of the vibration generating device includes an open upper end and an open lower end, the upper and lower ends allowing air flow into the duct, and an outflow passage located between the upper and lower ends, the outflow passage being in communication with the second opening, and further comprising a moving member disposed in the duct and configured to move within the duct in a direction of an airflow drawn into the duct, and wherein the vibrating member is adapted to move in response to movements of the moving member, wherein the vibrating member is configured so that movements of the vibration member selectively open and close the upper end and lower end of the duct, and wherein movements of the vibrating member generate vibration.

4. A suction nozzle as claimed in claim 3, wherein the duct includes a plurality of guide pieces fitted to an outside surface of the duct at fixed intervals for guiding movements of the vibrating member.

5. A suction nozzle as claimed in claim 3, wherein the moving member includes at least one moving plate having a diameter smaller than an inside diameter of the duct.

6. A suction nozzle as claimed in claim 5, wherein the moving member includes;

an upper plate, a lower plate, and connecting members for connecting the upper plate and the lower plate.

7. A suction nozzle as claimed in claim 6, wherein the connecting members in the moving member are fitted tilted at angles to a vertical line for causing the moving member to make the up and down movements while the moving member rotates.

8. A suction nozzle as claimed in claim 6, wherein the moving member further includes a supplementary plate between the upper plate and the lower plate.

9. A suction nozzle as claimed in claim 3, wherein the vibrating member includes;

an upper cover for selectively opening and closing the upper end of the duct in response to movements of the moving member, a lower cover for selectively opening and closing the lower end of the duct in response to movements of the moving member, and a connecting shaft for connecting the upper cover and the lower cover.

10. A suction nozzle as claimed in claim 9, wherein sound absorbing and vibration damping material is fitted to at least one surface of an upper surface and a lower surface of the upper cover and the lower cover.

11. A suction nozzle as claimed in claim 9, wherein the connecting shaft has a lower end that passes through the lower cover and extends through a bottom surface of the housing, and further comprising a vibration plate attached to the lower end of the connecting shaft, and wherein movement of the vibrating member causes the vibration plate to hit the suction nozzle body to generate vibration.

12. A suction nozzle as claimed in claim 11, wherein sound absorbing and vibration damping material is fitted to an upper surface of the vibration plate.

13. A suction nozzle as claimed in claim 9, wherein the connecting shaft has a lower end that passes through the lower cover, and that extends through a bottom surface of the housing and a bottom surface of the suction nozzle body, and further comprising a vibration plate attached to the lower end of the connecting shaft, wherein movement of the vibrating member causes the vibration plate to hit an object located adjacent the bottom surface of the suction nozzle body.

14. A suction nozzle as claimed in claim 13, wherein the suction nozzle body has a recess in the bottom surface thereof, and wherein the vibration plate is disposed at least partially within the recess.

15. A suction nozzle as claimed in claim 14, wherein the vibration plate is disposed in front of the main suction hole of the suction nozzle body.

16. A suction nozzle as claimed in claim 1, further comprising at least one additional vibration generating device mounted in the supplementary air flow passage.

17. A suction nozzle as claimed in claim 1, wherein the supplementary air flow passage includes:

an upper partition wall formed inside the suction nozzle body, and a lower partition wall formed inside the suction nozzle body.

18. A suction nozzle as claimed in claim 17, wherein the duct of the vibration generating device includes an open upper end and an open lower end, the upper and lower ends allowing air to flow into the duct, and an outflow passage located between the upper and lower ends, the outflow passage communicating with the main air flow passage, and further comprising a moving member disposed in the duct, wherein the moving member moves in the duct according to a direction of an airflow in the duct, and wherein the vibrating member is adapted to move in response to movements of the moving member, wherein movement of the vibrating member selectively opens and closes the upper end and lower end of the duct, and wherein movement of the vibrating member generates vibration.

19. A suction nozzle as claimed in claim 18, wherein the moving member includes:

an upper plate, a lower plate, and connecting members for connecting the upper plate and the lower plate.

20. A suction nozzle as claimed in claim 19, wherein the vibrating member includes:

an upper cover for selectively opening and closing the upper end of the duct, a lower cover for selectively opening and closing the lower end of the duct, and a connecting shaft for connecting the upper cover and the lower cover.

21. A suction nozzle as claimed in claim 20, wherein the connecting shaft has a lower end that extends through a bottom surface of the suction nozzle body, and further comprising a vibration plate connected to the lower end of the connecting shaft.

22. A suction nozzle as claimed in claim 21, wherein the suction nozzle body has a recess in the bottom surface thereof, wherein the vibration plate is mounted at least partially within the recess, and wherein the main suction hole is located in the recess.

23. A suction nozzle as claimed in claim 22, wherein the vibration plate extends along a longitudinal direction of the suction nozzle body, and wherein the vibration plate has a plurality of projections on a bottom surface thereof.

24. A suction nozzle as claimed in claim 23, wherein the projection have a plurality of supplementary projections on a bottom of the projections.

25. A suction nozzle as claimed in claim 21, wherein a plurality of sound absorbing material pieces are fitted on at least one of an upper surface of the vibration plate and the bottom surface of the suction nozzle body.

26. A suction nozzle as claimed in claim 21, wherein a plurality of hollow guide members are formed in the suction nozzle body, wherein a plurality of projections are formed on the vibration plate, and wherein the projections are configured to slide within the guide members so that movement of the vibration plate is guided by the guide members.

27. A suction nozzle as claimed in claim 21, wherein the supplementary suction hole has sound absorbing material fitted thereto.

28. A suction nozzle as claimed in claim 21, wherein the supplementary suction hole has a cover fitted thereto, and wherein the cover is adapted to selectively close the supplementary suction hole to provide for selective operation of the vibration plate.

29. A suction nozzle as claimed in claim 21, wherein the suction nozzle body includes a transparent window located at a position that allows a user to verify an operational state of the vibration generating device by looking through the window.

30. A suction nozzle as claimed in claim 21, wherein projections are formed on one of the upper surface and the lower surface of the upper cover and the lower cover.

31. A suction nozzle as claimed in claim 21, wherein supporting members are provided inside of the suction nozzle body for supporting the duct.

32. A suction nozzle as claimed in claim 21, wherein hooks are formed at the top end and the bottom end of the connecting shaft, wherein a rib is formed below each of the hooks for preventing the upper cover and the lower cover from moving along the connecting shaft, and wherein the hooks have an outside diameter that is greater than an outside diameter of the connecting shaft, with a cut off middle portion.

33. A suction nozzle as claimed in claim 21, further comprising a bottom plate that is detachably mounted to the bottom surface of the suction nozzle body.

34. A suction nozzle as claimed in claim 33, wherein the bottom plate includes:

a first longitudinal member located behind the vibration plate and having a plurality of recesses in a bottom surface thereof for reducing friction, and a second longitudinal member located behind the main suction hole and having ribs projected from a bottom surface thereof for concentration of a suction force toward the main suction hole.

35. A suction nozzle as claimed in claim 34, wherein a plurality of transverse ribs, each with a given curvature, are provided behind the first longitudinal member, for reducing friction.

36. A suction nozzle as claimed in claim 34, wherein a transverse recess is formed in front each of the ribs.

37. A suction nozzle as claimed in claim 33, wherein the bottom plate includes a plurality of transverse members for preventing the vibration plate from being stopped.

38. A suction nozzle as claimed in claim 21, wherein a supplementary wheel is fitted to the bottom of the suction nozzle body for maintaining a gap between the bottom of the suction nozzle body and a surface of a cleaning object.

39. A suction nozzle as claimed in claim 21, wherein the connecting shaft extends above the upper cover and below the lower cover, and further comprising a guide member of an elastic material disposed between the extended portions of the connecting shaft and the duct for guiding movements of the upper cover and the lower cover.

40. A suction nozzle as claimed in claim 21, wherein the connecting shaft extends above the upper cover and below the lower cover, wherein the duct is provided with supporting members, each with a guide hole, and wherein a guide member is fitted between an extended portion of the connecting shaft and the guide hole.

41. A suction nozzle as claimed in claim 21, further comprising a blast air flow passage formed in the suction nozzle body for blasting external air from the bottom of the suction nozzle body.

42. A suction nozzle as claimed in claim 41, wherein the blast air flow passage is formed between the supplementary suction hole and the bottom of the suction nozzle body.

43. A suction nozzle as claimed in claim 21, further comprising an overload protection device mounted in the supplementary air flow passage, wherein the overload protection device opens to provide an opening between the supplementary air flow passage and the main air flow passage in a case of overload of the supplementary air flow passage.

44. A suction nozzle as claimed in claim 43, wherein the overload protection device includes:

a hollow case mounted in the upper partition wall, a spring fitted inside of the case, and a cover fitted at a fore end of the spring.

45. A suction nozzle as claimed in claim 43, wherein the overload protection device includes a flap of an elastic material having a first end fixed to one portion of the upper partition wall over an opening in the upper partition wall and a second end brought into close contact with another portion of the upper partition wall below the opening.

46. A suction nozzle as claimed in claim 1, wherein the duct of the vibration generating device includes an open first end and an open second end, the first and second ends allowing air to flow into the duct and an outflow passage located between the first and second ends and opening to the main air flow passage, further comprising a moving member disposed in the duct, wherein the moving member moves according to a direction of an air flow in the duct, wherein the vibrating member moves in response to movements of the moving member, and wherein the vibrating member selectively opens and closes the first and second ends of the duct.

47. A suction nozzle as claimed in claim 46, wherein the vibrating member includes:

a first cover for selectively opening and closing the first end of the duct in response to horizontal movement of the moving member, a second cover for selectively opening and closing the second end of the duct in response to horizontal movement of the moving member, and a connecting shaft that connects the first and second covers.

48. A suction nozzle as claimed in claim 47, further comprising a moving plate attached to the first and second covers, wherein the moving plate also moves horizontally when the vibrating member moves horizontally.

* * * * *